US005404862A

United States Patent [19]

Ohta et al.

[11] Patent Number: 5,404,862

[45] Date of Patent: Apr. 11, 1995

[54] ENGINE FUEL INJECTION CONTROLLER

[75] Inventors: Kenji Ohta; Ichiro Itonaga, both of Yokosuka; Hatsuo Nagaishi, Yokohama, all of Japan

[73] Assignee: Nissan Motor Co., Ltd., Yokohama, Japan

[21] Appl. No.: 122,091

[22] Filed: Sep. 16, 1993

[30] Foreign Application Priority Data

Sep. 18, 1992 [JP] Japan ..... 4-249999

[51] Int. Cl.[6] ..... F02M 51/00

[52] U.S. Cl. ..... 123/698

[58] Field of Search ..... 123/698, 489, 674, 680, 123/520

[56] References Cited

U.S. PATENT DOCUMENTS

| | | | |
|---|---|---|---|
| 4,831,992 | 5/1989 | Jundt et al. | 123/520 |
| 5,048,092 | 9/1991 | Davenport et al. | 123/489 |
| 5,048,493 | 9/1991 | Orzel et al. | 123/698 |
| 5,090,388 | 2/1992 | Hamburg et al. | 123/698 |
| 5,143,040 | 9/1992 | Okawa et al. | 123/684 |
| 5,216,997 | 6/1993 | Osani et al. | 123/698 |
| 5,224,462 | 7/1993 | Orzel | 123/696 |
| 5,245,978 | 9/1993 | Orzel | 123/674 |
| 5,299,546 | 4/1994 | Kato et al. | 123/520 |

FOREIGN PATENT DOCUMENTS

| | | | |
|---|---|---|---|
| 63-38650 | 2/1988 | Japan | 123/698 |
| 63-38656 | 2/1988 | Japan | 123/698 |
| 2-19631 | 1/1990 | Japan | 123/698 |
| 3-111639 | 5/1991 | Japan | 123/698 |

*Primary Examiner*—Raymond A. Nelli

*Attorney, Agent, or Firm*—Lowe, Price, LeBlanc & Becker

[57] ABSTRACT

Fuel injection controller is provided for an engine having a purge passage for purging fuel vapor from the fuel tank into the intake passage, a purge valve which opens and closes the purge passage and a mechanism for feedback correcting a fuel injection amount based on a detected air-fuel ratio. The controller comprises a device for detecting the fuel flowrate in the purge passage, a device for subtracting the fuel flowrate in the purge passage from the basic injection amount so as to correct the set injection amount, and a device for increasing a fuel feedback gain of the air-fuel ratio feedback correction. In this way, even if the air-fuel ratio feedback correction amount decreases due to purge, the air-fuel ratio feedback gain will not decrease and the response of the air-fuel ratio correction can be maintained.

17 Claims, 35 Drawing Sheets

| PURGE | CONDITIONS | | FIRST ΔWC | LATER ΔWC |
|---|---|---|---|---|
| OFF -> ON | ALPHA - ALPST ≥ -DALPH# | | +PWCH# | +IWCH# |
| | ALPHA - ALPST ≥ DALPH# | | -PWCH# | -IWCH# |
| | OTHERS | ALPAV < ALPST | +PWCL# | +IWCL# |
| | | ALPAV > ALPST | -PWCL# | -IWCL# |
| | | OTHERS | 0 | 0 |
| ON -> OFF | ALPHA - ALPST ≤ -DALPH# | | -PWCH# | -IWCH# |
| | ALPHA - ALPST ≥ DALPH# | | +PWCH# | +IWCH# |
| | OTHERS | ALPAV < ALPST | -PWCL# | -IWCL# |
| | | ALPAV > ALPST | +PWCL# | +IWCL# |
| | | OTHERS | 0 | 0 |

FIG.34

| PURGE | CONDITIONS | | FIRST ΔOFSTPV | LATER ΔOFSTPV |
|---|---|---|---|---|
| OFF -> ON | ALPHA - ALPST ≥ -DALPOG# | | -POFSH# | -IOFSH# |
| | ALPHA - ALPST ≥ DALPOG# | | +POFSH# | +IOFSH# |
| | OTHERS | ALPAV < ALPST | -POFSL# | -IOFSL# |
| | | ALPAV > ALPST | +POFSL# | +IOFSL# |
| | | OTHERS | 0 | 0 |
| ON -> OFF | ALPHA - ALPST ≤ -DALPOG# | | +POFSH# | +IOFSH# |
| | ALPHA - ALPST ≥ DALPOG# | | -POFSH# | -IOFSH# |
| | OTHERS | ALPAV < ALPST | +POFSL# | +IOFSL# |
| | | ALPAV > ALPST | -POFSL# | -IOFSL# |
| | | OTHERS | 0 | 0 |

FIG.38

MAP OF $P_R$ (%)

| TP (ms) | 1000 | 2000 | 3000 | 4000 |
|---|---|---|---|---|
| 6.0 | 5.0 | 4.6 | 4.3 | 4.0 |
| 4.5 | 5.4 | 4.9 | 4.6 | 4.2 |
| 3.0 | 5.7 | 5.2 | 4.8 | 4.4 |
| 1.5 | 6.0 | 5.5 | 5.0 | 4.5 |
| 0 | | | | |

NE (RPM)

FIG.44

MAP OF $P_L$ (%)

| TP (ms) | 1000 | 2000 | 3000 | 4000 |
|---|---|---|---|---|
| 6.0 | 4.0 | 3.6 | 3.3 | 3.0 |
| 4.5 | 4.4 | 3.9 | 3.6 | 3.2 |
| 3.0 | 4.7 | 4.2 | 3.8 | 3.4 |
| 1.5 | 5.0 | 4.5 | 4.0 | 3.5 |
| 0 | | | | |

NE (RPM)

FIG.45

MAP OF I (%)

| TP (ms) | 1000 | 2000 | 3000 | 4000 |
|---|---|---|---|---|
| 6.0 | 2.0 | 2.0 | 2.0 | 2.0 |
| 4.5 | 2.0 | 2.0 | 2.0 | 2.0 |
| 3.0 | 2.0 | 2.0 | 2.0 | 2.0 |
| 1.5 | 2.0 | 2.0 | 2.0 | 2.0 |
| 0 | | | | |

NE (RPM)

FIG.46

ENGINE FUEL INJECTION CONTROLLER

FIELD OF THE INVENTION

This Invention relates to an engine equipped with a mechanism purging fuel vapor in a fuel tank to an intake passage of the engine, more specifically, to a fuel injection control system for such an engine,

BACKGROUND OF THE INVENTION

In automobile engines, in order to prevent the escape of fuel vapor from a fuel tank into the atmosphere, the vapor is for example adsorbed by a canister of active carbon, and the adsorbed fuel is purged in the intake passage of the engine under predetermined running conditions. The fuel is removed from the canister and led into the intake passage by making use of the pressure difference between the atmosphere and the intake passage. For this purpose, the canister and intake passage are connected by a purge line, a purge valve which operates under predetermined running conditions being interposed in this line. Purge gas flowing into the intake passage from the purge line is led into the engine cylinder together with fuel injected by an injector provided in the intake passage, and burnt.

In many automobile engines which employ a three-way catalyst to process the engine exhaust gas, the air-fuel ratio (AFR) of the fuel mixture provided to the engine cylinder is feedback-controlled to stay in a certain region of a theoretically defined value. For example, a basic fuel amount is computed based on the intake volume of the engine, and this basic fuel injection amount is corrected based on the actual AFR detected by an oxygen sensor provided in an exhaust passage of the engine.

When the aforesaid purge gas is introduced, the fuel amount supplied to the engine cylinder increases by an amount corresponding to the purged fuel, and naturally the AFR becomes richer. In an engine with the above AFR feedback control system, the injection amount from the injector is corrected so that it is decreased.

If for example the detected AFR changes from lean to rich with reference to the theoretical value, an updating amount P is subtracted in one step from the feedback correction coefficient $\alpha$, and an updating amount I are then subtracted integrally until the AFR next changes back to lean. This is so-called "PI control". The correction coefficient $\alpha$ can therefore be varied only in fixed proportions corresponding to a fixed feedback gain, and if the AFR is varying rapidly, a certain response time is required until the AFR can be made to converge to a target value.

If now the accelerator pedal is depressed so that the vehicle accelerates while fuel is being purged from the canister, the intake amount immediately increases, but the flowrate of purge gas does not vary so much. The fuel supplied to the engine is therefore insufficient due to the fact that the purge gas amount has decreased relative to the intake amount, so this deficiency is compensated by feedback control which increases the fuel amount injected by the injector.

Just before acceleration, however, the feedback control correction coefficient $\alpha$ had shifted from a center value of 1.0 to lean (e.g. 0.8) so as to make the AFR converge to the target value. A relatively long time is therefore required for the coefficient to change back to rich which is necessary to increase the fuel amount so that the vehicle can accelerate, and during this time the engine does not respond properly. To deal with this problem, in Tokkai Hei 2 - 19631 published by the Japanese Patent Office, a method is proposed whereby the basic fuel amount is first decreased by a predetermined value while purge gas is being led into the cylinder, the AFR is modified to the target value (theoretical AFR) by feedback control, and the correction coefficient $\alpha$ is maintained close to the center value of 1.0 even during purge. For this purpose, the AFR correction coefficient $\alpha$ before stating purge is compared with the AFR correction coefficient $\alpha$ after purge which has fallen to a stable level below the predetermined value. By first subtracting a fuel correction amount corresponding to this difference from the basic fuel amount, the correction coefficient $\alpha$ during purge is thereby forcibly maintained in the region of 1.0 which is the center value. When the accelerator pedal is depressed, therefore, the feedback control correction coefficient $\alpha$ shifts to rich from the region of 1.0. Compared to the case when it shifts to rich from lean, the fuel amount increases more rapidly, hence the engine acceleration response is improved.

If the control gain of the correction coefficient $\alpha$ is increased, the response is improved when there are transient and other fluctuations of the AFR, but the correction width of the AFR is too large in the steady state. This causes the AFR to "hunt" around the target value which destabilizes the control. The control gain of the correction coefficient is therefore set to an appropriate value from the viewpoint of both response and stability.

In the final analysis, however, it is the fuel injection amount supplied by the injector which is corrected by the correction coefficient. More specifically, this correction is a predetermined ratio having a certain correction width which is applied to the fuel injection amount at one particular point in time, and it takes no account of fuel changes due to purge gas.

In actual fact, the AFR varies with the concentration and flowrate of purge gas, and if the AFR is corrected by feedback control, the width of the AFR which can be corrected by the correction coefficient is smaller the larger the effect of the purge gas. As a result, even if the correction coefficient $\alpha$ is maintained at a value near its center value during purge, it takes longer to make the AFR converge to a target value when the running conditions of the vehicle change and fuel fluctuations occur due to purge than when purge is not carried out. This leads to a worsening of exhaust gas composition during the period in question, and feedback control response during purge deteriorates.

SUMMARY OF THE INVENTION

It is an object of this invention to correct AFR errors rapidly by increasing the control gain of the feedback correction coefficient during purge as compared to the setting when purge is not carried out.

It is a further object of this invention to maintain the stability and response of the AFR error correction during purge by varying the control gain of the feedback correction coefficient, i.e., the feedback gain, depending on the purge gas flowrate.

In order to achieve the above objects, this invention provides a fuel injection controller for an engine having a combustion chamber, an intake passage connected to the combustion chamber, a fuel tank for storing fuel, an injector for injecting fuel from the fuel tank into the intake passage, a device for detecting running conditions of the engine, a purge passage for introducing fuel vapor from the fuel tank into the intake passage as a purge gas, and a purge valve which opens and closes the purge passage according to the engine running conditions. This controller comprises a device for setting a basic fuel injection amount of the injector based on a predetermined target air-fuel ratio and the engine running conditions, a device for detecting an air-fuel ratio of air and fuel supplied to the combustion chamber, a feedback device having a feedback gain for feedback correcting the basic fuel injection amount by a predetermined correction unit amount such that the detected air-fuel ratio is identical to the target air-fuel ratio, and a device for increasing the feedback gain by a predetermined amount when the purge valve is open.

It is preferable that the controller further comprises a device for detecting a purge fuel flowrate in the purge passage and decreases the basic fuel injection amount when the purge valve is open by an amount equivalent to the detected purge fuel flowrate. With this flowrate detecting device, the feedback gain amount may be increased according to the purge fuel flowrate. The flowrate detecting device comprises for example a computer which computes the purge fuel flowrate based on a pressure difference before and after the purge valve, and based on a variation of the air-fuel ratio due to the purge valve opening or closing.

The feedback correcting device preferably causes the basic injection amount to vary in stepwise fashion when the air-fuel ratio detected has varied beyond the target air-fuel ratio and causes the basic fuel injection amount to vary progressively at other times. These step variation amount and progressive variation amount are increased respectively when the purge valve is open.

The details as well as other features and advantages of this invention are set forth in the remainder of the specification and are shown in the accompanying drawings.

BRIEF DESCRIPTION OF THE DRAWINGS

FIG. 34 is a table specifying values of a learning updating amount ΔWC provided in the fuel injection controller.

FIG. 35 is a graph showing the variation of purge learning values when the fuel injection controller switches the purge valve to PURGE ON.

FIG. 38 is a table specifying values of a learning updating amount ΔOFSPV provided in the fuel injection controller.

FIG. 39 is a graph showing the variation of offset learning values OFSTPV when the fuel injection controller switches the purge valve to PURGE ON.

FIG. 44 is a map of a step amount PR provided in the fuel injection controller.

FIG. 45 is a map of a step amount PL provided in the fuel injection controller.

FIG. 46 is a map of an integral amount I provided in the fuel injection controller.

DESCRIPTION OF THE PREFERRED EMBODIMENTS

Figure 1:
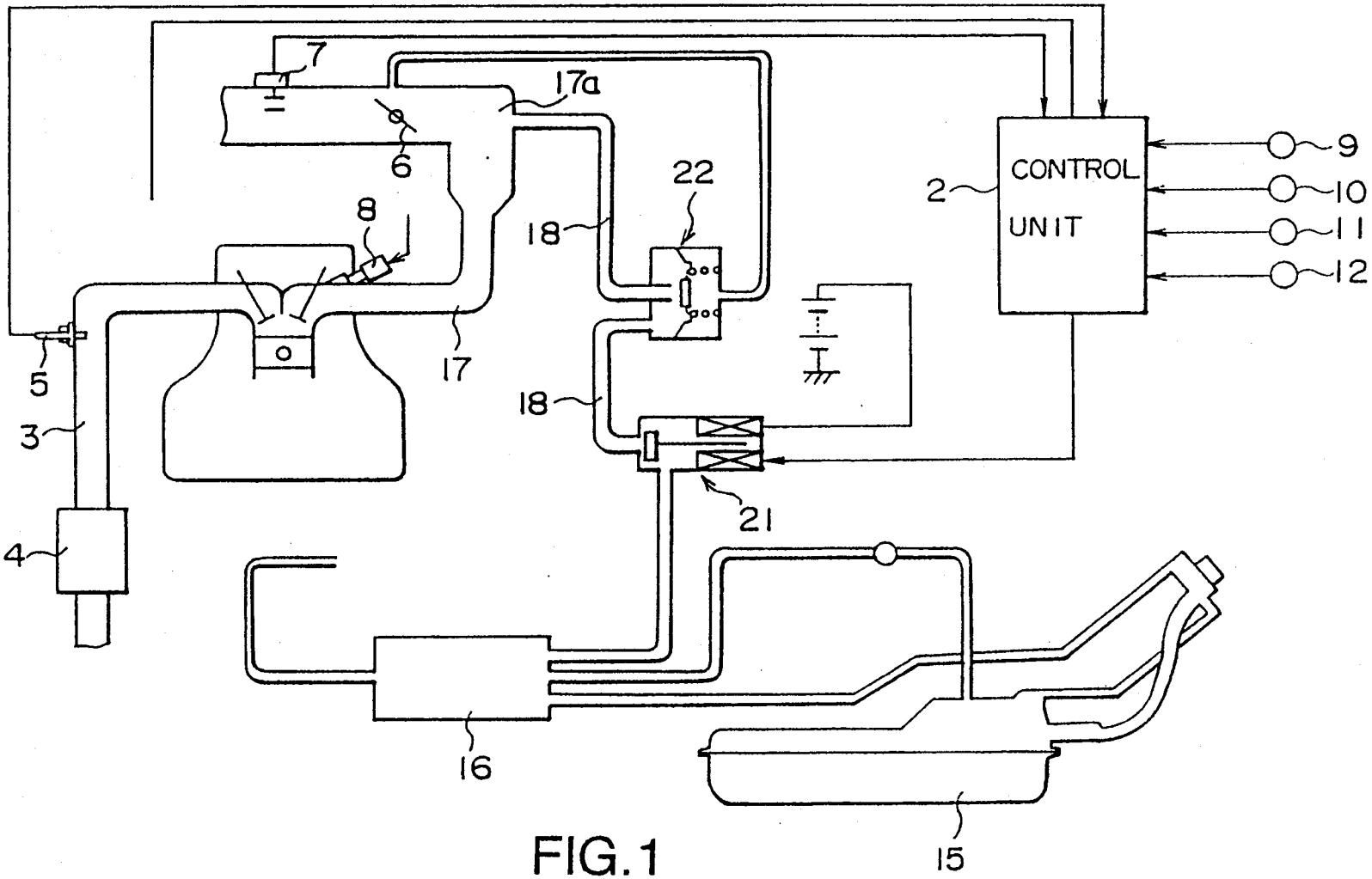
FIG. 1 is a schematic diagram of a fuel injection controller according to this invention.

Referring to FIG. 1 of the drawings, a throttle valve 6 for adjusting the intake air volume and an air flow meter 7 for measuring the intake air volume are disposed in an intake pipe 17 of an automobile engine. Fuel is injected into the intake air from an injector 8, and the mixture of air and fuel is supplied to an engine cylinder.

A control unit 2 consisting of a microprocessor determines a valve opening pulse width (injection pulse width) of the injector 8 which intermittently opens in synchronism with the engine such that the ratio of the intake air volume measured by the air flow meter 7 upstream of the throttle valve 6 to the fuel amount supplied to a cylinder from the injector 8 (i.e. the AFR) is almost equal to a theoretical AFR regardless of the engine running conditions.

Fuel stored in a fuel tank 15 is supplied to the injector 8 via a pump, not shown. A catalytic converter 4 containing three-way catalyst for treating the three toxic components in the exhaust, i.e. CO, HC and NOx, is installed in an exhaust pipe 3.

If the three-way catalyst is to be able to treat these three toxic components simultaneously, the AFR of the gas mixture supplied to the engine must lie within a narrow range (referred to hereinafter as a catalyst window) having the theoretical AFR as its center. If the AFR shifts to the rich side of in this catalyst window, the amount of CO and HC which is discharged increases, while if it shifts to the lean side, more NOx is discharged. The controller 2 feedback controls the fuel injection amount based on a real AFR signal from an oxygen ($O_2$) sensor 5 installed upstream of the catalytic converter 4 of the exhaust pipe 3 such that the AFR of the gas mixture supplied to the engine cylinder is always within the catalyst window.

The characteristics of the $O_2$ sensor are such that its output varies rapidly at an exhaust gas oxygen concentration corresponding to the gas mixture having the theoretical AFR. If the mixture is on the rich side of the theoretical AFR, its output is approximately 1-volt, while if the mixture is on the lean side, its output is approximately 0-volt. Further, if the $O_2$ sensor output is higher than a slice level of approximately 0.5-volt, it is determined that the AFR of the gas mixture is rich, while if its output is lower than this slice level, it is determined that the AFR of the gas mixture is lean. If this determination is synchronized with the engine rotation, a determination may be made as to whether the AFR has just changed to rich from lean or vice versa, or whether it is continuously on the rich or lean side.

Based on these determination results, the controller 2 performs feedback control of the AFR. In other words, immediately after the AFR has changed to rich, a step amount P is subtracted from the AFR feedback coefficient $\alpha$, and integral amount I are then subtracted from $\alpha$ until just before the AFR changes to lean. On the other hand, P is added to $\alpha$ immediately after the AFR has changed to lean, and I are then added to $\alpha$ until just before the AFR changes to rich. By adding a large value P in a stepwise manner immediately after there has been a change-over of AFR, a fast response is obtained, and by subsequently adding small values I after this stepwise change, the AFR is reverted to the other side gradually. In this way, the feedback control is stabilized.

In order to perform this feedback control, signals are input to the controller 2 from a crank angle sensor 9 for outputting a signal corresponding to the engine rotation speed and a Ref signal showing the basic position of the crank angle, a sensor 10 for detecting the opening TVO of the throttle valve 6, a water temperature sensor 11 for detecting the temperature of the engine cooling water, and a vehicle speed sensor 12 for detecting the vehicle speed.

If however the injector 8 becomes clogged with the passage of time, the fuel amount supplied is less even if the injector 8 is driven with the same pulse width, and every time the engine is started, the AFR will tend to be on the lean side for some time after AFR feedback control begins. To avoid this, the controller 2 performs basic AFR learning. The average value of the correction coefficient $\alpha$ settles at a higher value (around which $\alpha$ fluctuates) than the control center value (1.0) some time after AFR feedback control begins. Therefore, if this value $\alpha m$ is stored as a basic AFR learning value in a battery back-up, the injection pulse width is increased by an amount corresponding to the learning value $\alpha m$ from when the engine next starts running, hence the AFR can be maintained within the catalyst window from the very start of feedback control.

The fuel supplied to the engine is not only injected by the injector 8, but is also supplied as purge gas from a purge passage 18 connected to an active carbon canister 16. The purpose of this canister 16 is to adsorb, on active carbon, fuel which has evaporated in the fuel tank 15 when the engine is at rest. The adsorbed fuel is separated from the active carbon by atmospheric air led into the canister when the engine is running, and is aspirated as purge gas together with air from the passage 18 into the intake pipe 17 by the negative pressure of the pipe 17.

The passage 18 is connected to a collector 17*a* downstream of the throttle valve 6 of the intake pipe 17, a purge valve 21 and diaphragm valve 22 being provided midway in the passage 18. This purge valve 21 is driven by a linear solenoid which responds to pulse signals sent at fixed intervals (e.g. 6.4 ms) from the controller 2. Its opening is increased the larger an ON duty corresponding to the proportion of ON time.

Figure 2:
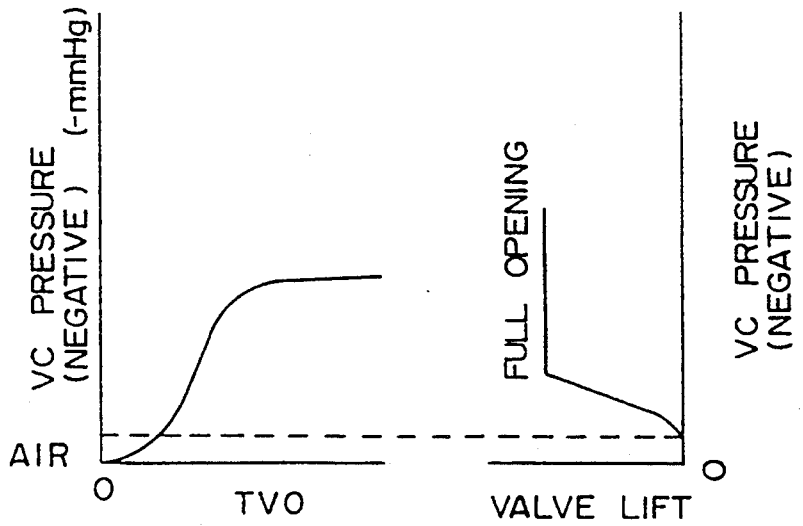
FIG. 2 is a diagram showing the operational characteristics of a VC negative pressure valve according to this invention.

If the purge valve 21 sticks in the fully open position and the adsorbed fuel in the active carbon canister 16 is purged, the engine may stall and its idle rotation speed may increase. The diaphragm valve 22 is intended to prevent this from occurring, and opens or closes according to a VC negative pressure which is related to the throttle opening TVO as shown in FIG. 2. In other words, if the accelerator pedal is returned to its idling position and the throttle 6 is closed, the VC negative pressure approaches atmospheric pressure, and the diaphragm 22 closes the passage 18 regardless of whether the purge valve 21 is open or closed.

This purge of adsorbed fuel is performed during AFR feedback control, but if the basic AFR learning value $\alpha m$ is updated also during purge, an error occurs in the learning value $\alpha m$. The controller 2 therefore prohibits updating of the learning value $\alpha m$ during purge.

However, if the fluctuation of AFR which becomes richer after purge begins, is made to correspond only to the correction coefficient $\alpha$, as $\alpha$ can vary only in fixed proportions, the AFR will be rich for a relatively long time after starting purge until the variation of $\alpha$ has finished. According to this invention, therefore, the controller 2 controls the vehicle such that the AFR error during purge is reduced as far as possible according to the flowcharts shown in FIG. 4–FIG. 21.

First, the basic concept of this control will be simply described with reference to FIG. 3, then each item will be described in more detail. The jobs comprising this control are executed in different time intervals as necessary.

Figure 3:
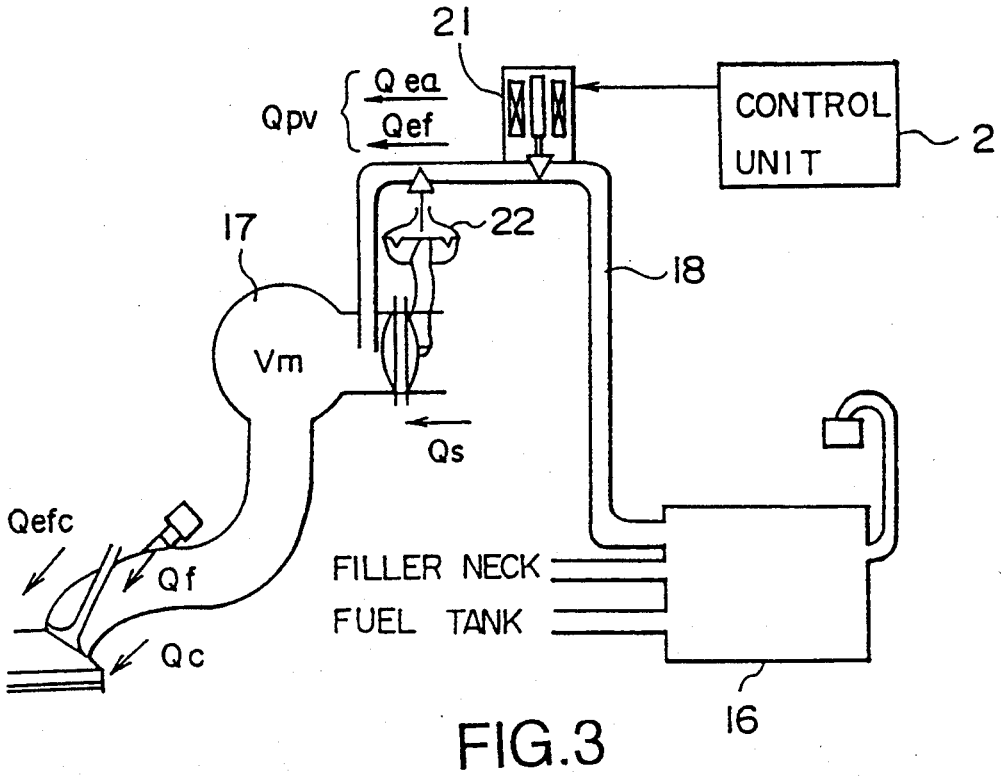
FIG. 3 is a diagram showing the flow of fuel and air in a fuel gas purge system according to this invention.

As shown in FIG. 3, the purge valve flowrate QPV, which is the sum of the fuel flowrate and the air flowrate through the purge passage, is determined by the purge valve duty EVAP and the pressure difference before and after the purge valve. A purge fuel flowrate QEF may be calculated by:

$$QEF=QPV\cdot WC \quad (1)$$

where, WC=purge gas fuel concentration.

A purge air flowrate QEA contained in the purge valve flowrate QPV may be calculated by:

$$QEA=QPV-QEF\cdot KFQ\# \quad (2)$$

where, KFQ#=a constant for converting the fuel flowrate to an air flowrate.

The air flowrate immediately downstream of the purge gas inlet of the intake air pipe 17 is the sum of this QEA and the air flowrate Qs measured by the air flow meter 7.

If the air flowrate (Qs+QEA) at an upstream position of the intake pipe 17 is determined, the air volume Qc in the engine cylinder may be found by applying a manifold cylinder filling model:

$$Qc=(Qs+QEA)\cdot Fload+Qc\cdot(1-Fload) \quad (3)$$

where, Fload is a weighting coefficient.

A fuel injection amount Qf from the injector 8 installed in an engine intake port may be expressed by:

$$Qf=Qc\cdot K\#-QEFC \quad (4)$$

where, K#=constant for making the AFR constant
QEFC=purge fuel cylinder intake amount QEFC is determined with respect to QEF assuming that the fuel gas diffuses as it passes along, and that there is a simple time delay. According to this controller, the fuel concentration WC of the purge gas is calculated with a high degree of precision by learning so as to determine how much correction is needed for the air volume and fuel volume during purge. Conventionally, the fuel concentration was not measured, a suitable value merely being found from experience. There was thus room for improvement in the exhaust performance or running performance of the vehicle when there was a change-over to PURGE ON or PURGE OFF.

Next, each item of the control process of this controller will be described in detail. In this description, English capital letters will in principle be used for symbols denoting quantities, and expressions used in programming language will be used for symbols and commands used in computations.

Calculation of a target duty EVAPT of the purge valve 21, determination of purge cut conditions, and determination of whether or not learning can be performed, take place according to the flowcharts shown in FIG. 4–FIG. 8. This control is performed as a background job which does not affect the execution periods of other controls.

1. Purge Cut Conditions 1.1 Full cut

If any of the following conditions (1)–(5) are satisfied, the purge valve 21 is immediately fully closed by setting the purge valve duty EVAP=0. Under these conditions, the diaphragm valve 22 closes, so the purge valve 21 also closes. On the other hand, if all these conditions are released, the purge valve 21 progressively opens.

Figure 6:
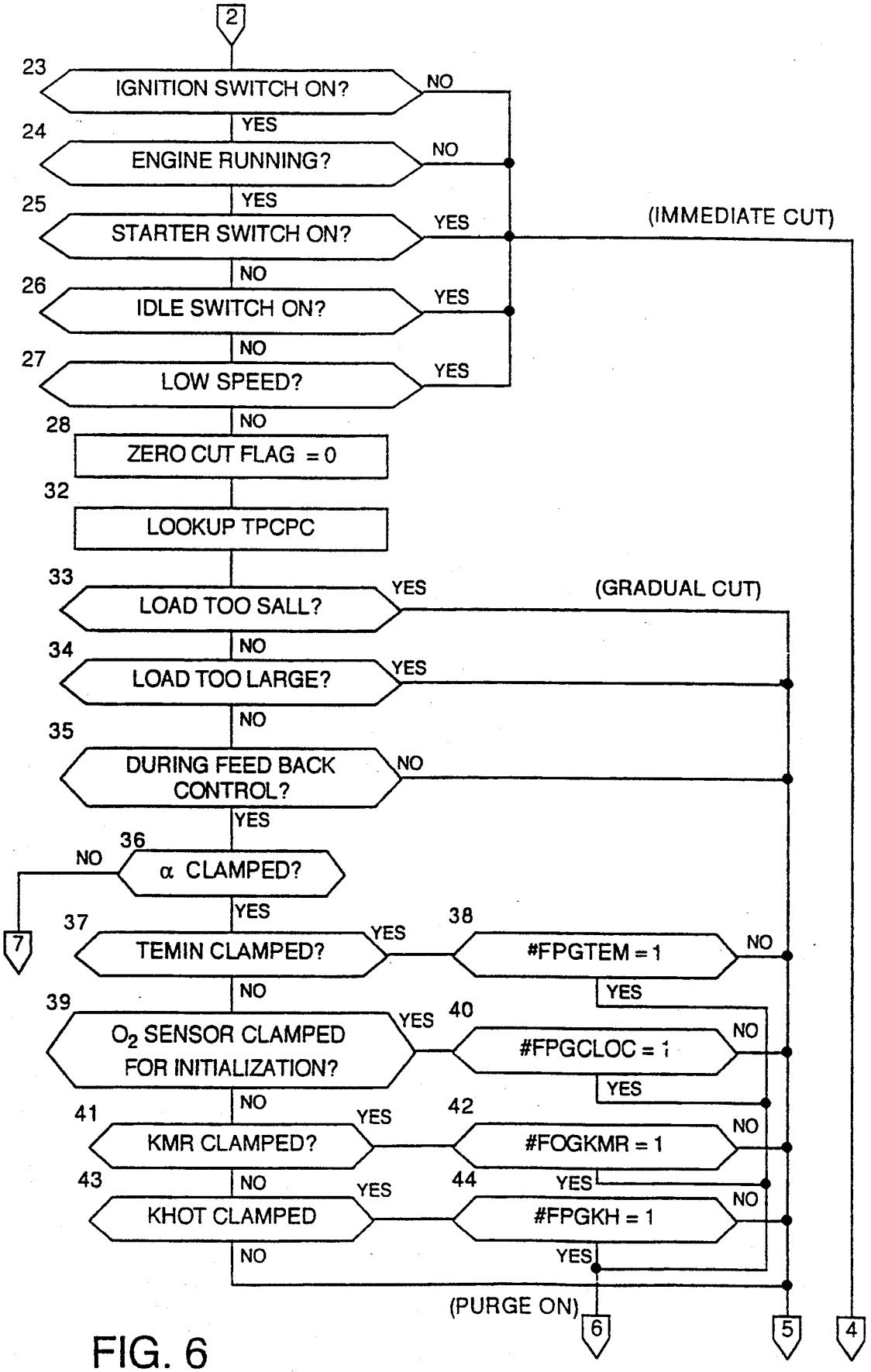

(1) The ignition switch is OFF (step 23 in FIG. 6).
(2) The engine is not running (step 25 in FIG. 6).
(3) The start switch is ON (step 25 in FIG. 6).
(4) The idle switch is ON (step 26 in FIG. 6).
(5) The vehicle speed VSP is below a predetermined value VCPC# (step 27 in FIG. 6).

Figure 7:
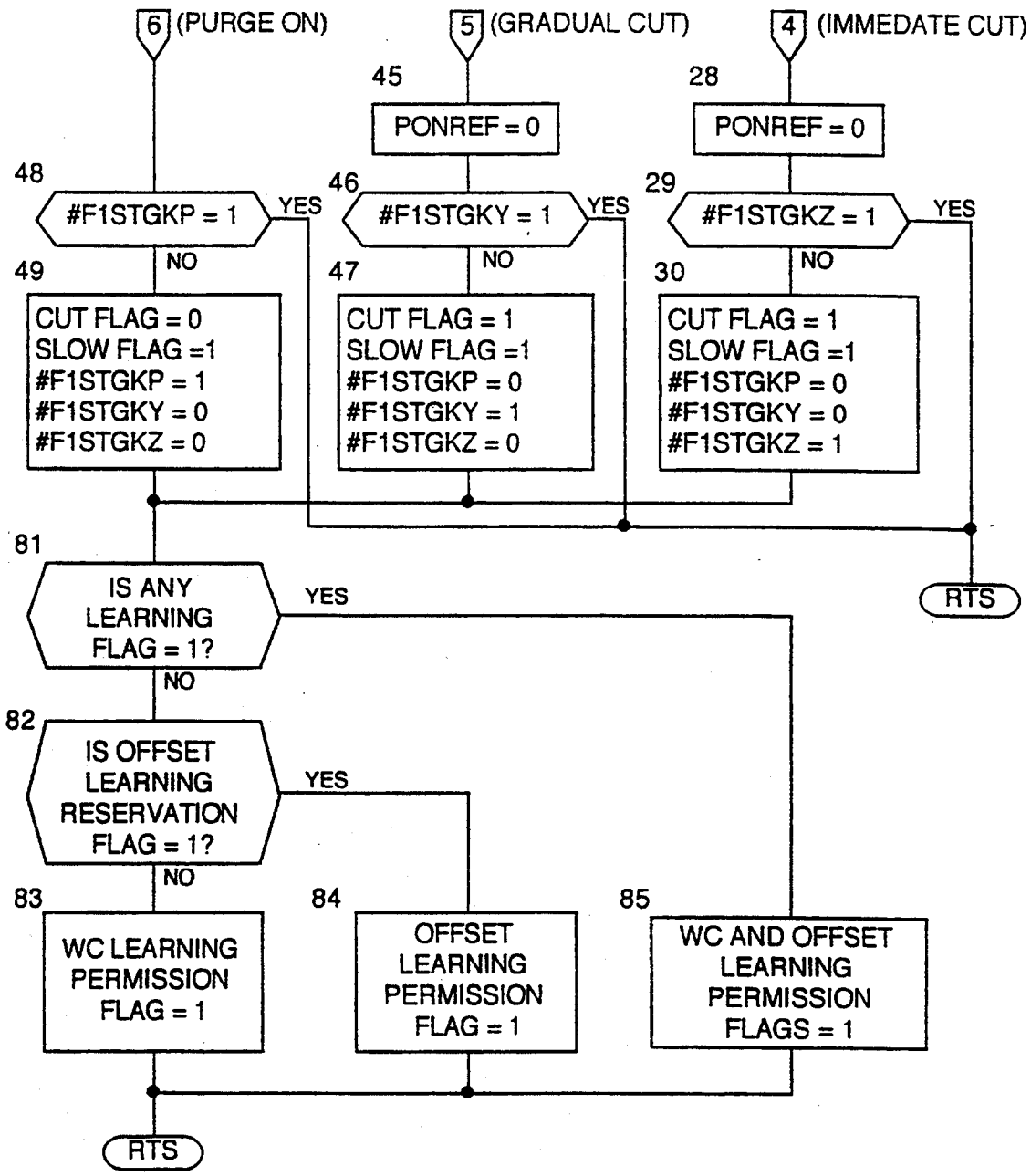

These conditions are checked, and if any of them are satisfied, a zero cut flag and a cut flag are set equal to 1 (steps 23–27 of FIG. 6, and step 30 of FIG. 7). The setting of the cut flag to 1 indicates and operation for closing the purge valve, and the setting of the zero cut flag to 1 indicates immediate cut.

These flags only have to be set once, so if the non-initial flag #FISTGKZ=1 in a step 29 of FIG. 7, it is determined that the required flags are already set, and the program leaves the routine without proceeding to the step 30.

If the non-initial flag=0, the non-initial flags #FISTGKP and #FISTGKY, which relate to the progressive cut mode and PURGE ON mode, are set to 0, and a count value PONREF of a continuous PURGE ON time is set to 0. Further, the non-initial flag #FISTGKZ of the full cut mode is set to 1 (steps 30, 28 of FIG. 7).

1.2 Progressive cut

If any of the following conditions (6)–(11) are satisfied, the purge valve 21 is progressively closed. This is due to the fact that if purge is performed under these conditions, running performance and exhaust performance are adversely affected. if all these conditions are released, the purge valve 21 is progressively opened. (6) The load is too small (step 33 in FIG. 6).

For example, a pulse width TP corresponding to the cylinder air volume and a lower purge permission limit TPCPC are compared, and if TP<TPCPC, it is determined that the load is too small (steps 32, 33 in FIG. 6).

Figure 30:
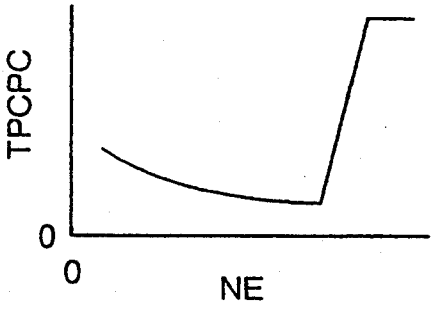
FIG. 30 is a graph showing a table of lower load limiting values TPCPC for purging provided in the fuel injection controller.

The lower purge permission limit TPCPC is found by looking up a table in FIG. 30 and performing an interpolation calculation from an engine revolution speed NE. In the following description, the operation of looking up a table wherever stated should always be understood to contain an interpolation calculation.

(7) The load is too large (step 34 in FIG. 6).

For example, a throttle valve air volume flowrate QHO and an upper purge permission limit EVPCQH# are compared, and if QHO>EVPCQH#, it is determined that the load is too large. The air flowrate QHO is determined from the engine revolution speed NE and throttle opening TVO as in the prior art.

(8) The AFR is not under AFR feedback control (step 35 in FIG. 6).

This is due to the fact that the AFR cannot be maintained within the catalyst window if the AFR is not under feedback control.

(9) The AFR is clamped.

If this case the AFR feedback correction coefficient $\alpha$ is fixed, AFR feedback control has effectively stopped, and artificial selection flags set to correspond to the following clamps provided as options, are set to 0 (steps 37–44 in FIG. 6):

(i) Temin clamp (flag #FPGTEM).

(ii) $O_2$ sensor initialization clamp (flag #FPGCLC).

(iii) High load region KMR clamp (flag #FPGKMR).

(iv) KHOT clamp (flag #FPGKH).

The clamp condition (i) corresponds to the case where the effective pulse width Te, obtained by subtracting a non-effective pulse width Ts from a quantity TI described hereinafter, is less than a minimum value. The clamp condition (ii) corresponds to the period during which the $O_2$ sensor is being initialized. The clamp condition (iii) corresponds to the high load region. The clamp condition (iv) corresponds to high water temperature when the engine tends to overheat.

The reason why artificial selection flags were used is due to the fact that purge speed requirements are different according to the type of vehicle, i.e. to the fuel tank system, and it is desired to adjust the purge area. However, as AFR errors due to purge cannot be corrected during clamp, the developers made provisions so that the values of the flags could be artificially selected. The values of the flags are therefore determined according to engine specifications when the engine is developed.

Figure 31:
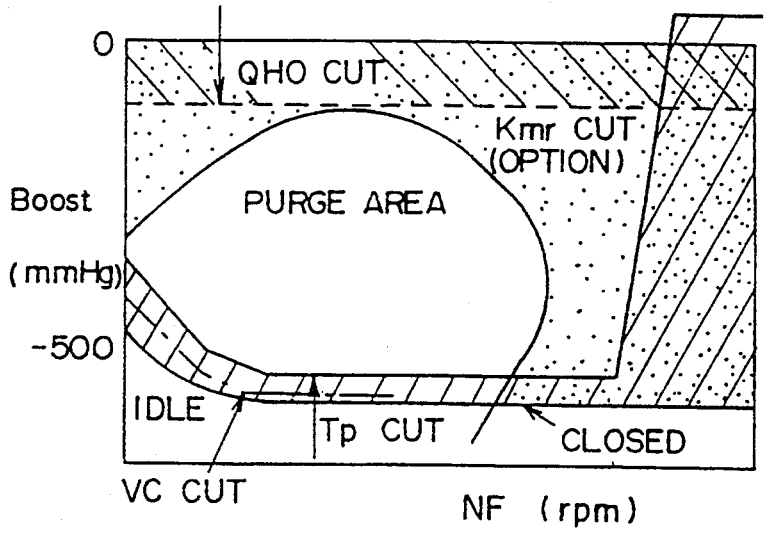
FIG. 31 is a graph showing a purging area according to this invention.

FIG. 31 shows what happens to the purge area after the aforesaid PURGE OFF areas are excluded. When condition (6) is satisfied, purge is cut off in the area shown by the TP cut arrow in the figure. When condition (7) is satisfied, purge is cut off in the area shown by the QHO cut arrow in the figure. When condition (9)(iii) is satisfied, purge is cut off in the area shown by the KMR cut in the figure. The remaining area is the area where purging is carried out, but even in this area, purge cut may be carried out according to the setting of various options.

(10) A purge learning cut flag=1

Figure 8:
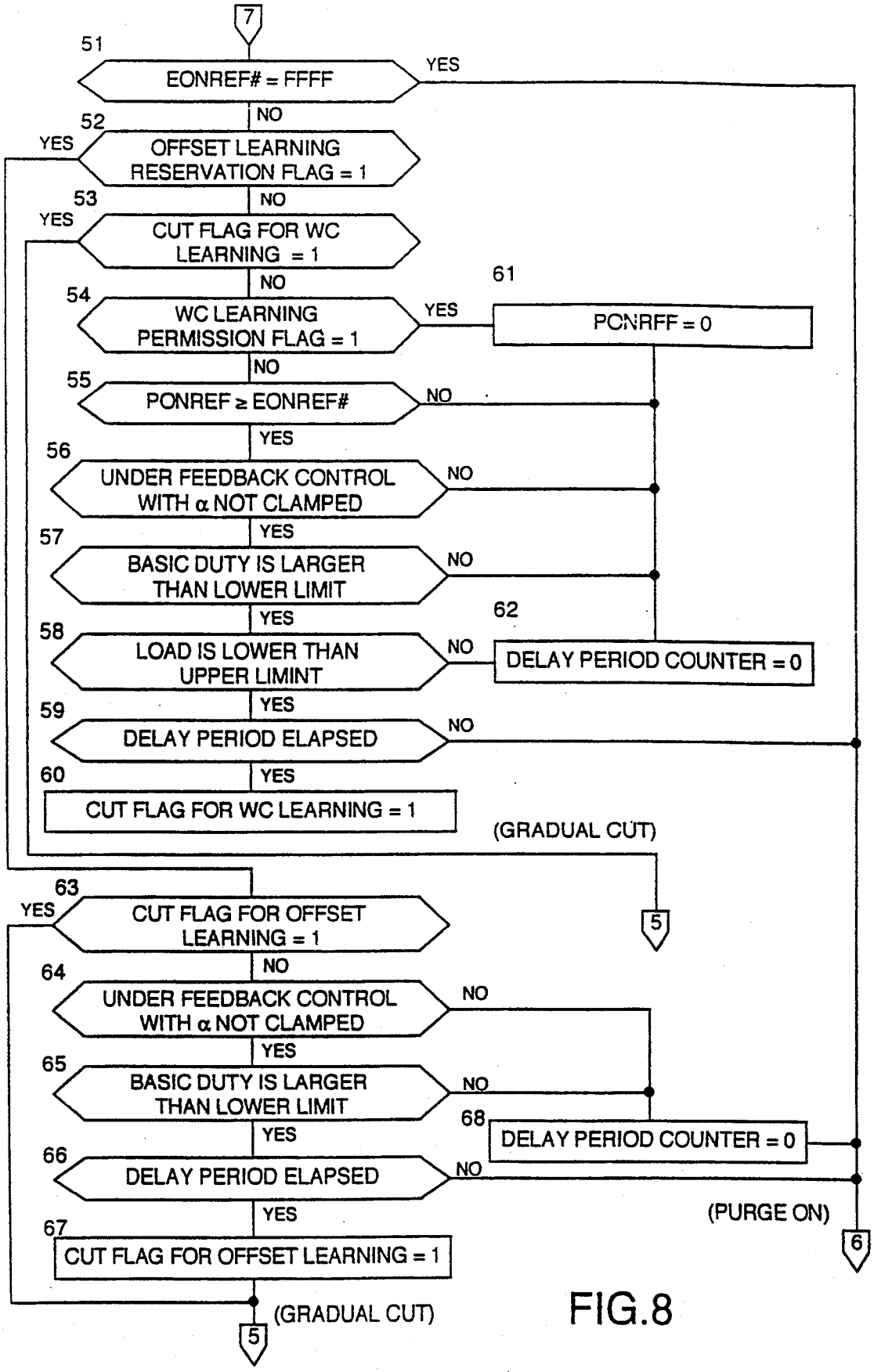

If all the following conditions are satisfied, a purge learning cut flag #FWCCUT is set equal to 1 (step 60 in FIG. 8). Purge learning will be described in more detail hereinafter.

(i) EONREF#≠ FFFF (step 51 in FIG. 8).

EONREF# is provided to select whether or not to artificially perform purge cut for purge learning. If FFFF, which is the maximum value in hexadecimal notation, is artificially substituted in EONREF#, purge cut for purge learning can be avoided. (ii) An offset learning reservation flag ≠1 (step 52 in FIG. 8).

Offset learning is learning to absorb scatter in the actuation of the purge valve 21, i.e. the scatter when the purge valve 21 begins to open. This will be described hereinafter.

(iii) A purge learning permission flag≠1 (step 54 in FIG. 8).

If the purge learning is permitted, a continuous PURGE ON time counter value PONREF is set to 0 (steps 54, 61 in FIG. 8). This counts the continuous PURGE ON time from when purge learning has finished.

(iv) The continuous PURGE ON time counter PONREF is greater than the predetermined value #EONREF (step 55 in FIG. 8).

(v) The AFR is under feedback control, and the $\alpha$ is not clamped (step 56 in FIG. 8).

(vi) A basic duty EVAPO, described hereinafter, is greater than a lower limit (step 57 in FIG. 8).

(vii) The load QHO is less than am upper limit (step 58 in FIG. 8).

(viii) A certain delay time has passed after the aforesaid conditions (i)–(vii) are satisfied (step 59 in FIG. 8).

More specifically, the reason why purge cut is performed when condition (iv) is satisfied is that if purge is performed too long, the fuel separating from the active carbon canister 16 decreases. The fuel concentration of the purge gas falls, and shifts away from the fuel concentration used for calculation (i.e. the purge learning value WC, described hereinafter). Therefore, even if the conditions are such as to permit purge, purge learning is performed while performing purge cut intermittently.

(11) An offset learning cut flag=1

If all the following conditions are satisfied, an offset learning cut flag is set equal to 1 (step 67 in FIG. 8).

(i) An offset learning reservation flag=1 (step 52 in FIG. 8).

As described hereinafter, this reservation is made when a purge learning value is clamped and purge learning has finished.

(ii) The AFR is under feedback control, and the $\alpha$ is not clamped (step 64 in FIG. 8).

(iii) The basic duty EVAPO, described hereinafter, is lower than an upper limit (step 65 in FIG. 8).

(iv) A certain delay time has passed after the aforesaid conditions (i)–(iii) are satisfied (CONTOFJ>OFGDLY#) (step 66 in FIG. 8).

If any of the aforesaid conditions (6)–(11) are satisfied, the cut flag is set equal to 1 and a slow flag is set equal to 1 (step 47 in FIG. 7). The setting of the slow flag to 1 indicates that the opening or closing of the purge valve is performed gradually. The purge valve 21 is therefore gradually closed by setting the slow flag to 1 and the cut flag to 1.

On the other hand, when all of these conditions (6)–(11) are released, the controller is changed over to PURGE ON. The cut flag is then set to 0 and the slow flag is set to 1 so as to gradually open the purge valve 21 (step 49 in FIG. 7).

If the purge valve 21 is opened or closed in stages, the flags only have to be set once and the continuous PURGE ON time counter (PONREF) is cleared as in the steps 29, 30, 28 in the case of immediate cut (steps 46, 47, 45, and steps 48, 49, in FIG. 7).

2. Purge Valve Opening Characteristics 2.1 Relation to purge cut conditions

Figure 9:
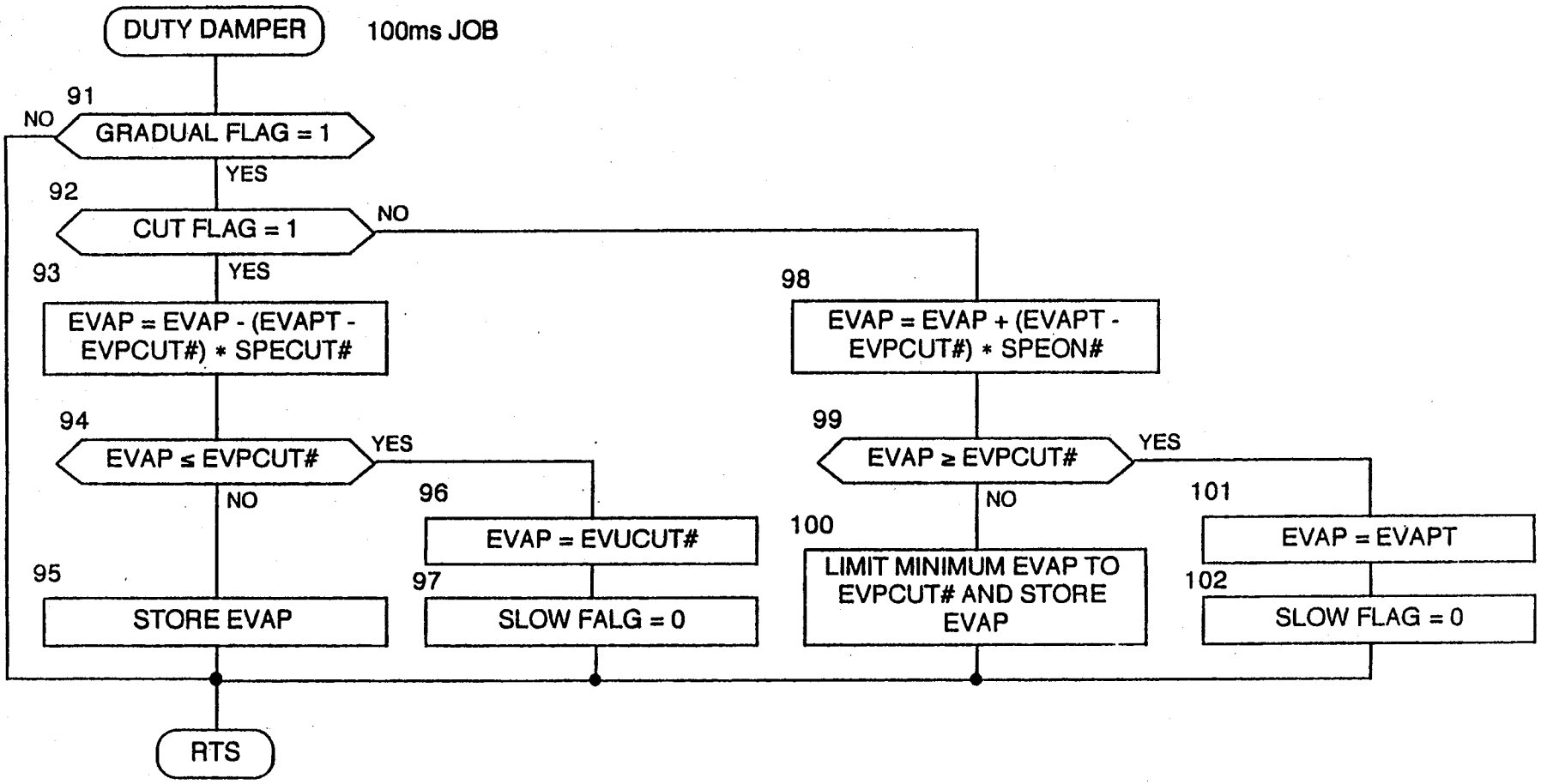
FIG. 9 is a flowchart showing the process of calculating a purge valve duty EVAP according to this invention.

If any of the aforesaid conditions (6)–(11) are satisfied, the purge valve duty EVAP is gradually reduced until it is equal to a purge valve target duty EVPCUT# during PURGE OFF (steps 91–95, and steps 91–94, 96, 97 in FIG. 9). The duty reduction rate at this time is expressed by (EVAPT-EVPCUT#)·SPECUT. SPECUT is a predetermined valve closing proportion of the purge valve per unit time, and EVAPT is a target duty during PURGE ON which will be described in the next section. The calculation of EVAP shown in FIG. 9 is carried out once every 100 ms as an independent job from the jobs of FIG. 4–FIG. 8.

If all of the aforesaid conditions (1)–(11) are released, EVAP is first set equal to EVPCUT#, and the purge valve duty EVAP is increased at a rate of (EVAPT - EVPCUT#) ·SPEON# until EVAP=EVAPT (steps 91, 92, 98–100, mid steps 91, 92, 98, 99, 101, 102 in FIG. 9). SPEON# is a predetermined valve opening proportion of the purge valve per unit time.

Figure 32:
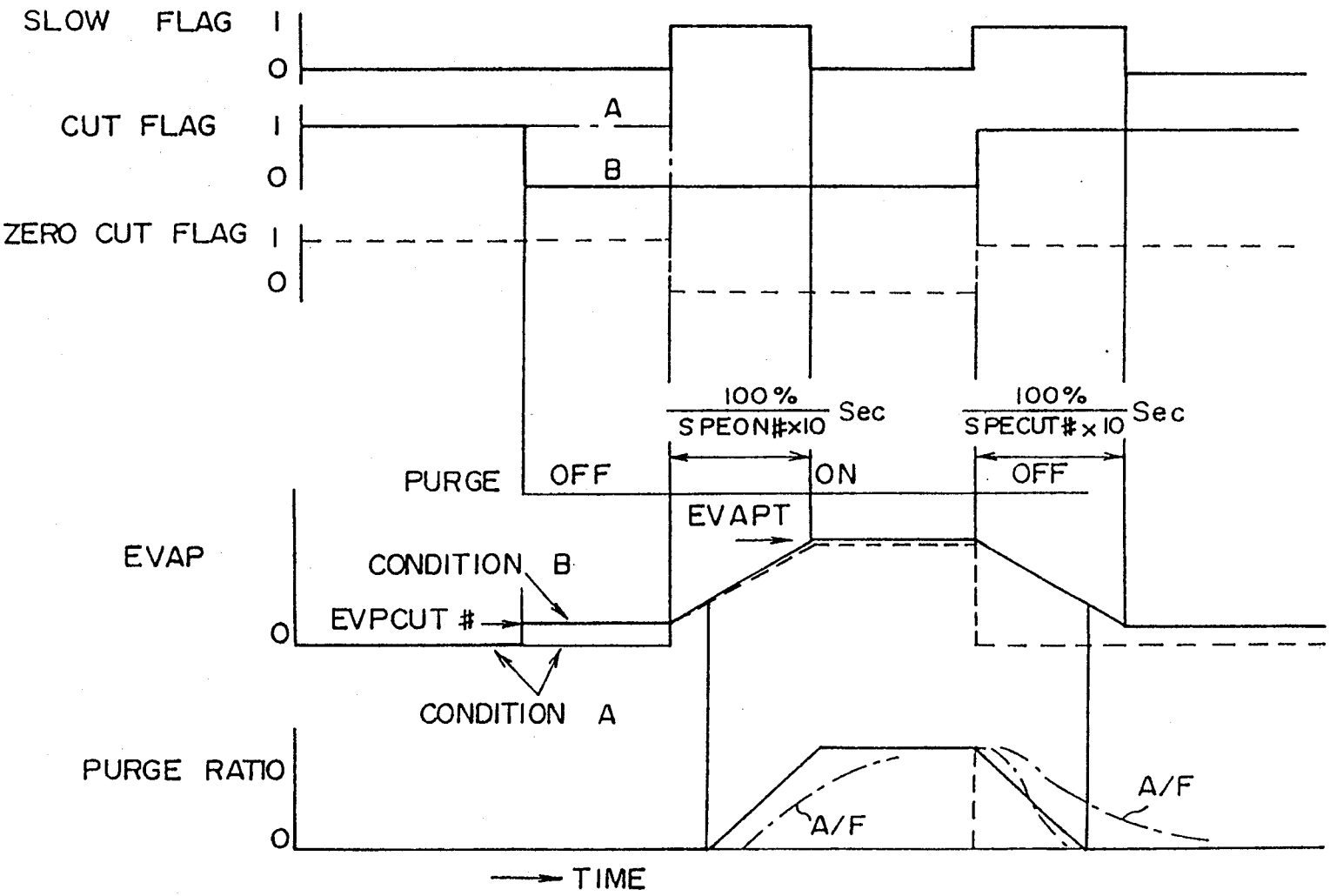
FIG. 32 is a graph showing a purge valve changeover pattern according to this invention.

The control waveform of the purge valve duty EVAP is shown by the solid line in FIG. 32. When there is a change-over from PURGE OFF to PURGE ON, EVAP is first set equal to EVPCUT#, and then gradually increases to EVAPT. When on the other hand there is a change-over from PURGE ON to PURGE OFF, EVAP is gradually decreased from EVAPT to EVPCUT#. In FIG. 32, the situation when there is a change-over to immediate cut is also shown by the broken line, and in this case only, EVAP becomes to 0 in one step.

Figure 4:
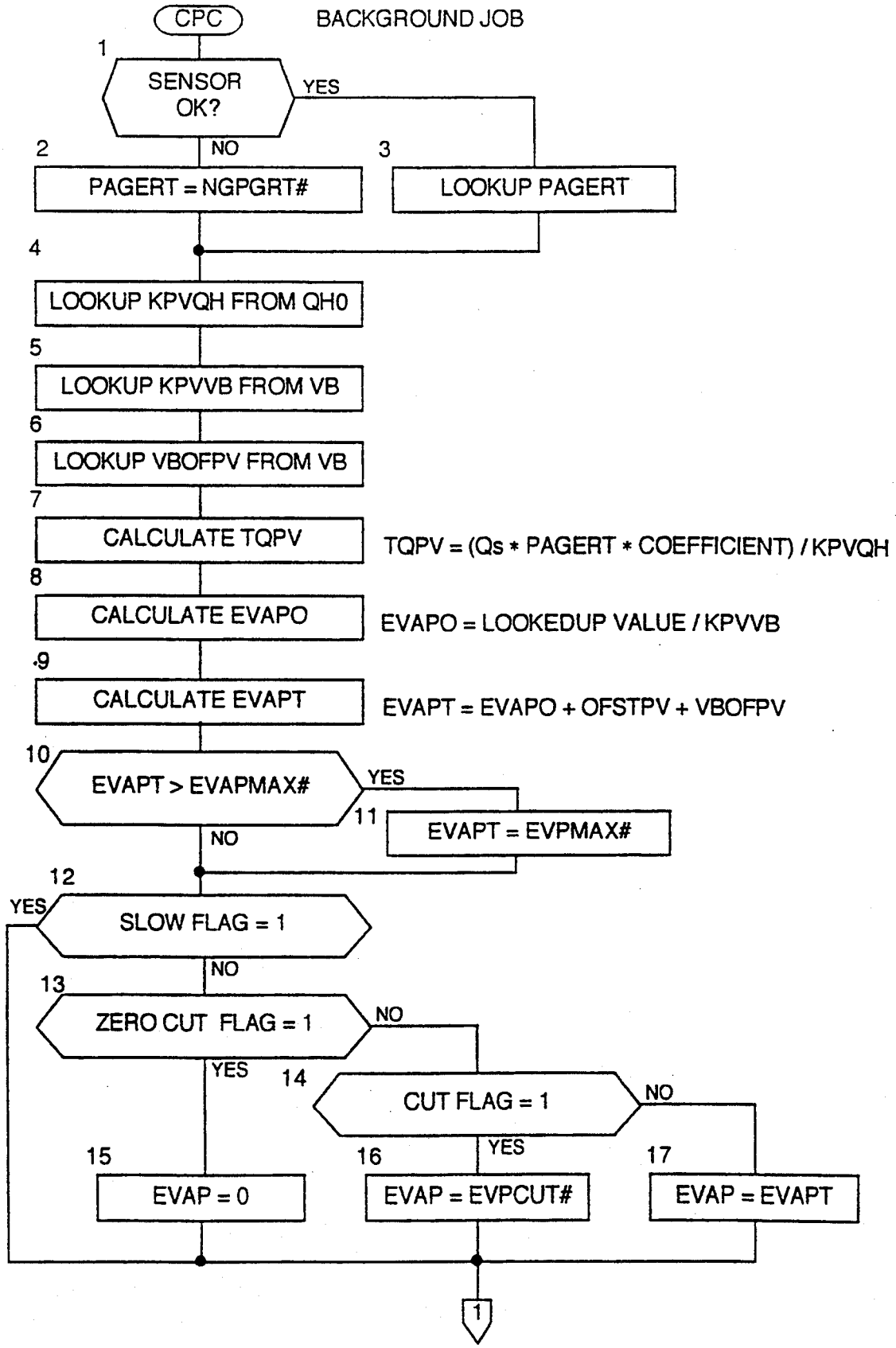
FIG. 4–FIG. 8 are flowcharts showing the process by which flags are set according to this invention.

The value of EVAP is also given in a background job in FIG. 4 (steps 12–17). If, in all cases, the value of EVAP is given by a job executed every 100 msec as shown in FIG. 9, a response delay arises in the change of EVAP when the engine running condition is transient. A response delay occurs even when it is desired to perform an immediate cut in a transient state. In order to change EVAP over to the required value promptly during such a transient state, EVAP is calculated by a background job except when the purge valve 21 is opened or close progressively.

2.2 Purge valve target duty

The purge valve target duty EVAPT is calculated by the following equation (step 9 of FIG. 4):

$$EVAPT=EVAPO+OFSTPV+VBOFPV \quad (5)$$

where, EVAPO=purge valve basic duty OFSTPV-=purge valve actuation duty learning value VBOFPV-=battery voltage correction factor of purge valve actuation duty EVAPT is provided with an upper limit (EVAPMAX#) (steps 10, 11 of FIG. 4).

Herein, OFSTPV of equation (5) is a learning value (referred to hereinafter as an offset learning value) corresponding to the purge valve actuation duty.

Figure 26:
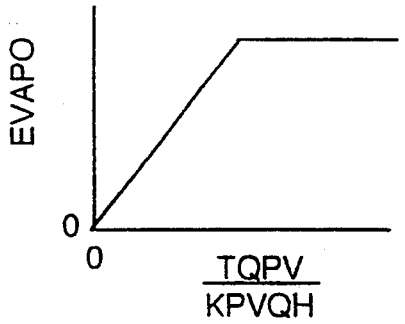
FIG. 26 is a graph showing a table of purge valve basic duties EVAPO provided in the fuel injection controller.

The basic duty EVAPO of equation (5) is calculated from:

$$EVAPO=constant \cdot TQPV/(KPVQH \cdot KPVVB) \quad (6)$$

where, TQPV=purge valve target flowrate KPVQH=negative pressure correction factor of purge valve flowrate KPVVB=battery voltage correction factor of purge valve flowrate or by looking up a table of the characteristics shown in FIG. 26. The purge valve target flowrate TQPV of equation (6) is given by:

$$TQPV=Qs \cdot PAGERT \quad (7)$$

where, Qs=intake air volume measured by air flow meter PAGERT=target purge rate

Figure 22:
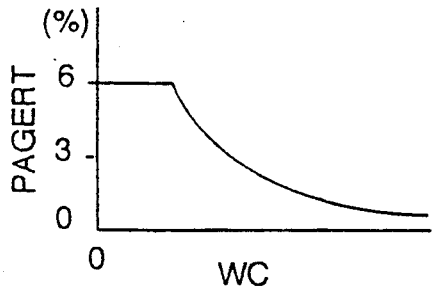
FIG. 22 is a graph showing a table of target purge rates PAGERT provided in the fuel injection controller.

The target purge rate PAGERT of equation (7) is found from the purge learning value WC corresponding to the fuel concentration of the purge gas by looking up a table of the characteristics shown in FIG. 22 (step 3 in FIG. 4).

As shown in FIG. 22, when WC is large, PAGERT is reduced, and when WC is small, PAGERT is increased. As the error in the AFR is large if the fuel concentration is high, the target purge rate PAGERT is decreased if WC is large, i.e. if the fuel concentration is high, mid the error in the AFR is thereby prevented from becoming large. On the other hand, when WC is small, i.e. the fuel concentration is low, purge is carried out rapidly at a high target purge rate.

In principle, even if the air flow meter flowrate Qs varies, the target purge rate PAGERT is made constant. It therefore has flat characteristics whether WC is large or small, as shown by the solid line in the upper graph of FIG. 33. However, the purge valve flowrate is a maximum when the purge valve 21 is fully open, and then gradually decreases as the air flow meter flowrate Qs increases as shown on the graph.

If there is a fault in the $O_2$ sensor, air flow meter or throttle sensor, PAGERT is set to a purge rate (constant) NGPGRT# for sensor faults (steps 1, 2 in FIG. 4).

In equations (6) and (7) there are five parameters, i.e. TQPV, KPVQH, KPVVB, Qs and PAGERT. When many parameters are used to determine EVAPO as in this case, the precision of the purge valve basic duty EVAPO is affected by the precision to which the number of bytes or the table is given with respect to these parameters.

In the flowchart of FIG. 4, therefore, the purge valve target flowrate TQPV is given by the following equation (step 7):

$$TQPV=(Qs \cdot PAGERT \cdot coefficient)/KPVQH \quad (8)$$

EVAPO is calculated by the following relation (step 8):

$$EVAPO=table\ value/KPVVB \quad (9)$$

The correction precision of these calculation equations is better than that of equations (6) and (7) above.

Figure 27:
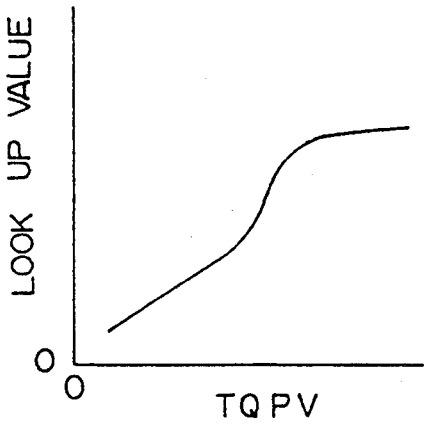
FIG. 27 is a graph showing a table of intermediate values for finding EVAPO provided in v controller.

The table value of equation (9) is found from the purge valve target flowrate TQPV by looking up a table of the characteristics shown in FIG. 27.

Figure 23:
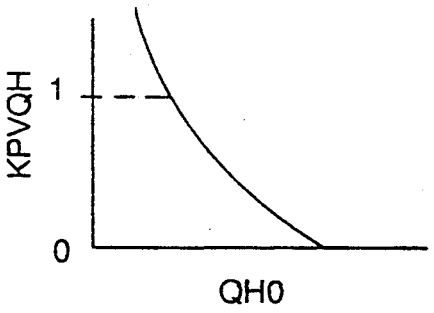
FIG. 23 is a graph showing a table of negative pressure correction rates KPVQH provided in the fuel injection controller.

KPVQH in equation (8) is a correction factor for the amount by which the flowrate varies due to the pressure difference before and after the purge valve although the surface area of the flow passage of the valve is constant, and is found from the air flowrate QHO by looking up a table of characteristics in FIG. 23 (step 4 in FIG. 4).

The flow of purge gas becomes more difficult the smaller the pressure difference before and after the purge valve. Therefore, if the throttle valve air flowrate QHO becomes larger, i.e. if the pressure difference before and after the purge valve becomes smaller for a constant purge valve opening, a correction is made so as to increase the purge valve target flowrate TQPV.

Herein, instead of actually detecting the pressure difference before and after the purge valve, QHO is used as a pressure difference equivalent amount. When the engine is in a transient running condition, a cylinder air volume equivalent pulse width TP represents the purge valve pressure difference better than QHO, so TP could also be used. However, the relation of TP to the purge valve pressure difference is affected by differences of atmospheric pressure and intake air temperature, therefore QHO is used herein. The concept of using cylinder air volume equivalent pulse width TP is known in the art. Even if the air volume is measured by an air flow meter, the air actually flows into the cylinder with a substantially first order delay. TP therefore gave a fuel amount which was in a constant proportional relationship to air entering the cylinder with in this first order delay.

Figure 24:
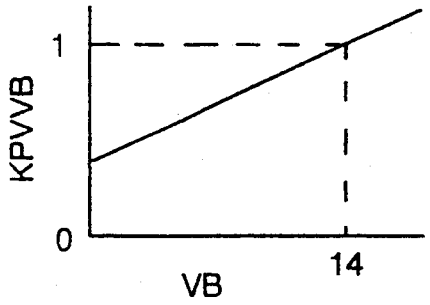
FIG. 24 is a graph showing a table of battery voltage correction rates KPVVB provided in the fuel injection controller.

KPVVB in equation (9) is found from a battery voltage VB by looking up a table of characteristics in FIG. 24 (step 5 in FIG. 4). When the battery voltage VB falls, even if the purge valve 21 is driven at the same EVAPO, the ON duty value falls and the purge valve flowrate decreases. The value of KPVVB (battery voltage correction factor) is therefore increased when the battery voltage VB falls, thereby increasing the ON duty value so as to maintain the same flowrate as before the battery voltage VB decreased.

Figure 25:
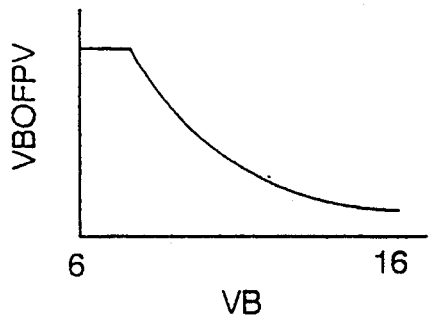
FIG. 25 is a graph showing a table of battery voltage correction rates VBOFPV related to purge valve actuation duty provided in the fuel injection controller.

VBOFPV, the battery voltage correction factor of the purge valve actuation duty in equation (8), is found from the battery voltage VB by looking up a table of characteristics in FIG. 25 (step 6). As in the case of the injector 8, the opening of the purge valve 21 does not perfectly correspond to the ON duty value, so a part of the duty has no useful effect. This part is affected by the battery voltage VB, and increases the more the battery voltage VB falls. If the battery voltage falls, the battery voltage correction factor of the purge valve actuation duty, VBOFPV, is therefore increased. In this way, the same flowrate is maintained regardless of the battery voltage VB.

The respective characteristics of the battery voltage correction factors, KPVVB and VBOFPV, differ according to the type of purge valve. FIGS. 24 and 25 refer to a purge valve driven by a linear solenoid.

2.3 Purge valve flowrate prediction value

A purge valve flowrate prediction value QV is given by the following relation (step 19 in FIG. 5):

$$QPV = EVAPQ \cdot KPVQH \quad (10)$$

where, EVAPQ=purge valve basic flowrate

KPVQH=negative pressure correction factor of purge valve flowrate

Figure 28:
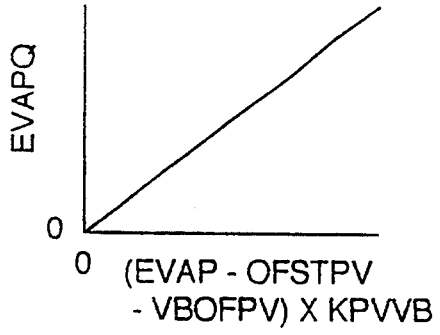
FIG. 28 is a graph showing a table of purge valve basic flowrates EVAPQ provided in this controller.

EVAPQ in equation 10 is found from (EVAP - OFSTPV - VBOFPV)·KPVVB by looking up a table of characteristics in FIG. 28 (step 18 in FIG. 5). in FIG. 28, the reason why the horizontal axis is not EVAPO·KPVVB is that the value of EVAP-OFSTPV-VBOFPV (i.e. the value during transient fluctuations) and the value of EVAPO (value in the steady state) are no longer identical when there is a change-over between PURGE ON and PURGE OFF.

3. Purge Learning Control

The purge gas mixing ratio is learned separately from the basic AFR learning value $\alpha m$. This corresponds to the purge gas fuel concentration. The reason why a purge learning value WC is provided separately from the basic AFR learning value $\alpha m$ is that, in contrast to the AFR error due to characteristic scatter in the air flow meter or the injector which has all extremely slow variation, the time fluctuation of the AFR error due to purge gas is relatively rapid. Therefore, by separating these learning values, the precision of AFR control is increased.

The fuel concentration of the purge gas is estimated as follows from $\alpha$, which varies when there is a change-over between PURGE ON and PURGE OFF.

Assume that there is no standing error of the AFR, and that when purge learning is performed one or more times, only the purge gas fuel becomes more concentrated compared to the immediately preceding occasion while other conditions remain the same. As a result the AFR shifts to rich, and the AFR feedback control coefficient $\alpha$ shifts to below the control center value (1.0) so as to return the AFR to lean. Thus, when $\alpha$ has shifted to a lower value, the purge learning value WC is updated to a larger value, this updated WC corresponding to a higher fuel concentration than on the immediately preceding occasion.

Conversely, when the fuel concentration is less than on the immediately preceding occasion, $\alpha$ shifts above the control center value. WC is then updated to a smaller value, the updated WC corresponding to a lower fuel concentration than on the immediately preceding occasion.

By estimating the purge gas fuel concentration in this way, AFR errors immediately after a change-over between PURGE ON and PURGE OFF can be prevented without installing a sensor.

3.1 Battery back-up

Figure 10:
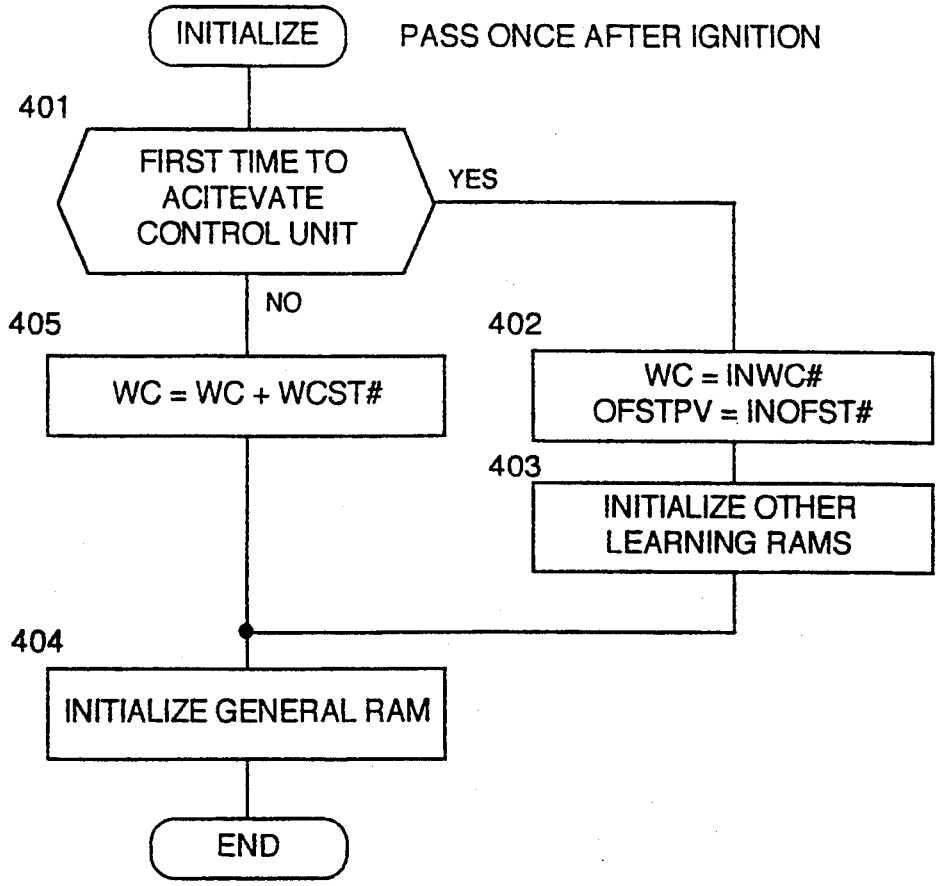
FIG. 10 is a flowchart showing the process of initializing a learning value WC according to this invention.

When the ignition is switched ON, the purge learning value WC is initialized once as shown in FIG. 10.

When current is first passed through the controller 2, WC is first set equal to 1NWC# (steps 401 and 402 in FIG. 10). 1NWC# is an initial value of WC for initial energization.

At all other times when current is passed through the controller 2, WC is set by the following equation (steps 401, 405 in FIG. 10):

WC=WC (storage value)+WCST# where, WCST#=WC addition value for engine start-up

WCST# takes account of the increase of fuel in the active carbon canister 16 when the vehicle is at rest. If no time elapsed from when the engine was previously at rest to engine start-up, there would be no AFR error due to the WC storage value even during purge when the engine is run. If time did elapse, however, fuel vapor collects in the active carbon canister, and this appears as an AFR error when the engine is started. This fuel vapor (i.e. the fuel vapor collected while the vehicle is at rest) is therefore estimated by WCST#.

Figure 11:
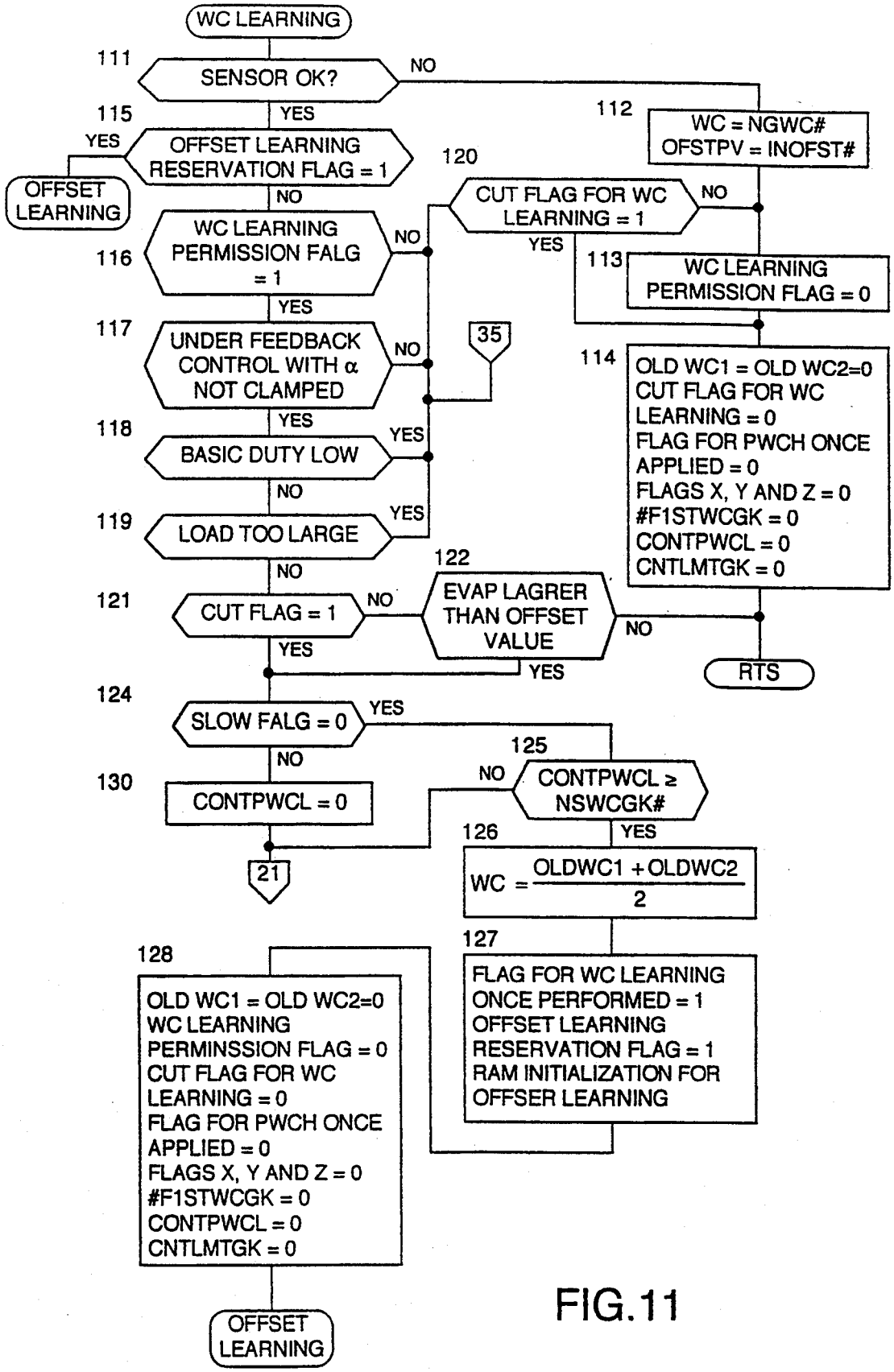
FIG. 11–FIG. 13 are flowcharts showing the process of updating the learning values WC according to this invention.
Figure 12:
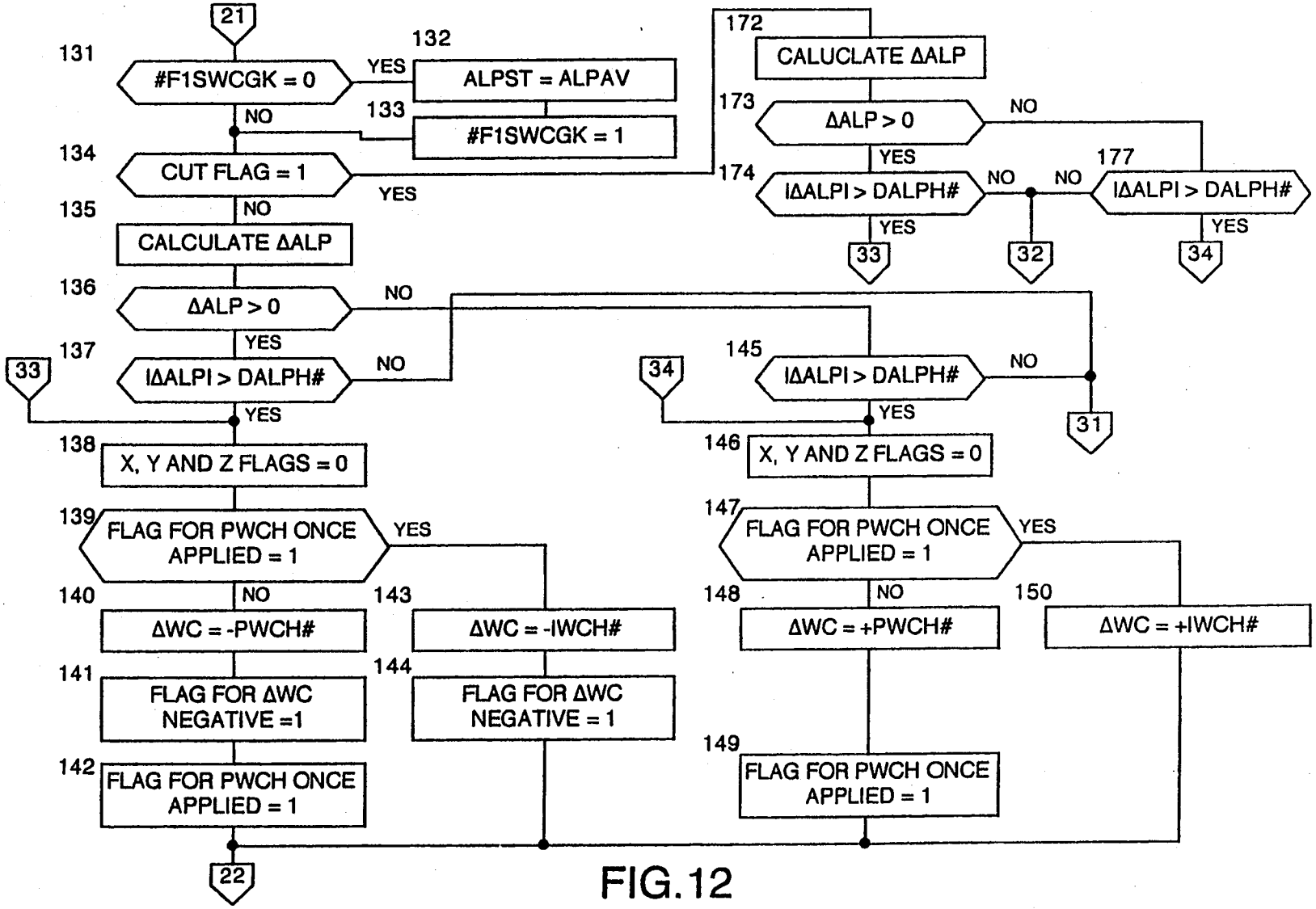
Figure 13:
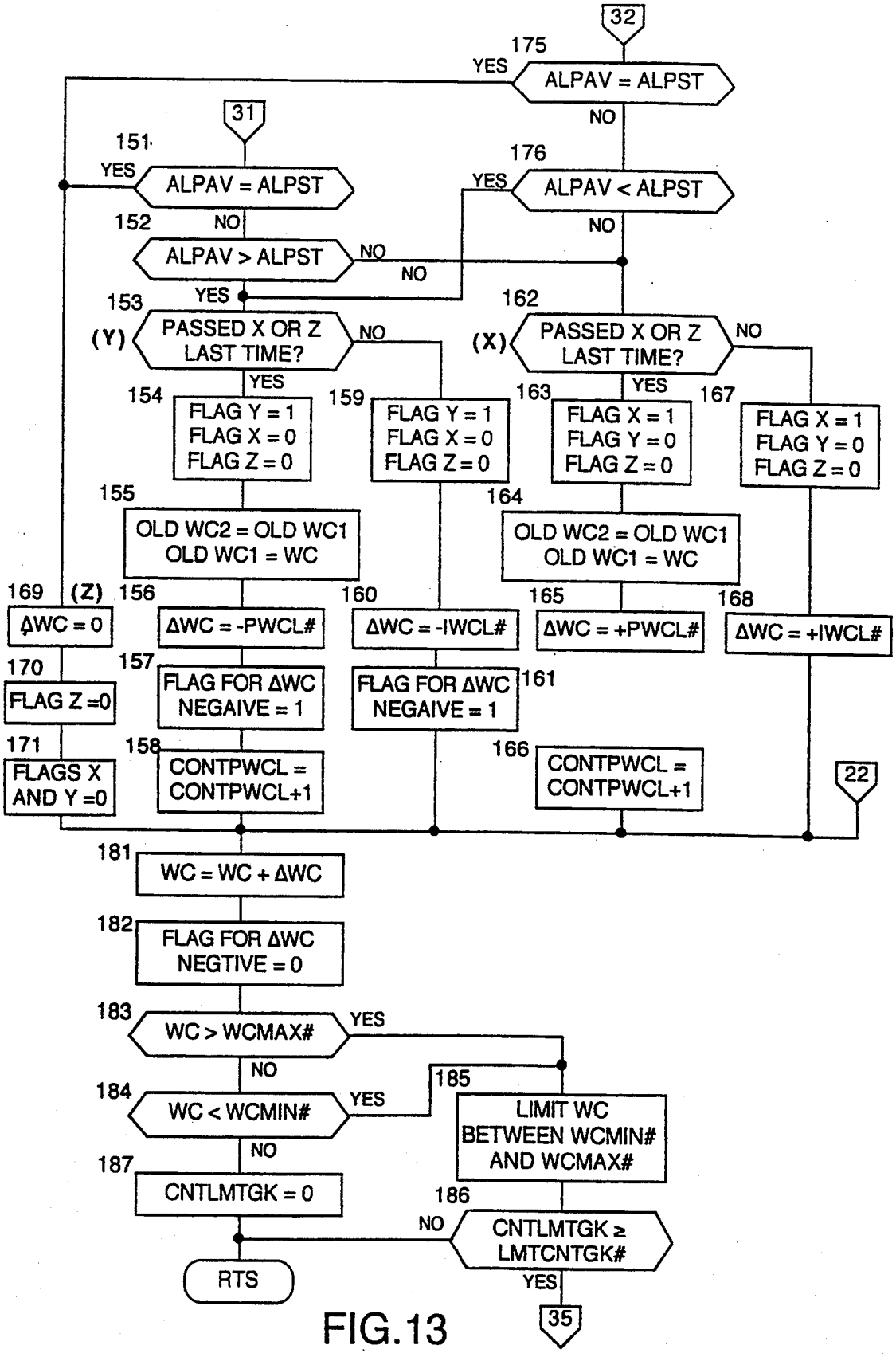

If any sensor has a fault in the WC learning process shown in FIGS. 11–13, WC is set equal to NGWC#, and purge learning is interrupted by setting the purge learning permission flag to 0 (steps 111–113 in FIG. 11). The RAM and flags for purge learning are also initialized or subjected to post-processing (step 114).

3.2 Purge learning permission conditions

Learning of the purge gas mixing ratio is permitted when there is a change-over to PURGE ON or PURGE OFF. This learning is therefore performed after setting a flag indicating a change-over to PURGE ON or PURGE OFF, i.e. following steps 30, 47 or 49 in FIG. 7. In FIG. 7, if offset learning is not reserved, a WC learning permission flag (#FWCGKOK) is set equal to 1 (steps 82, 83).

The reason why learning is permitted when there is a change-over to PURGE ON or PURGE OFF without waiting for $\alpha$ to stop varying is in order to increase the frequency of learning.

3.3 Purge learning interruption conditions

If the following conditions are satisfied, purge learning is interrupted (steps 116–119, 113 in FIG. 11).

(i) A purge learning permission flag=0 (step 116).

If there is a change-over from PURGE ON to PURGE OFF or vice versa during a period when purge learning conditions are satisfied, purge learning is interrupted (steps 81, 85 in FIG. 7).

(ii) The conditions are those other than when the AFR is under feedback control and $\alpha$ is not clamped (step 117 in FIG. 11).

This is because the conditions that the AFR is under feedback control, and that the learning value WC is not clamped, are learning conditions.

(iii) The purge valve basic duty (EVAPO) is smaller than a predetermined value (WCGDTY#) (step 118 in FIG. 11).

If the basic duty is small, it is impossible to know whether the AFR error is related to the basic duty or the purge valve actuation duty. Purge learning is therefore performed in the high flowrate region and offset learning in the low flowrate region of the purge valve as shown in the lower graph of FIG. 33.

(iv) The load represented by the throttle valve flowrate QHO is higher than a predetermined value WCGQH# (step 119 in FIG. 11).

If any of the interruption conditions (i)-(iv) are satisfied, the program proceeds from a step 120 to the step 114, but if the cut flag for purge learning=1 at any intermediate point, the program skips over the step 113 as shown in FIG. 11.

The reason why the purge learning permission flag is not set equal to 0 in this case is as follows. If for any reason purge learning is interrupted during a purge cut for purge learning, the purge valve 21 changes over to PURGE ON. If the purge learning permission flag is 0 at that time, the purge learning flag would be reset to 1 in steps 81-83 in FIG. 7 and PURGE ON learning would begin.

In PURGE ON learning, purge learning is not performed until the purge valve duty EVAP exceeds the purge valve offset amount. This offset amount may be set for example to the sum of the battery voltage correction factor VBOFPV related to the purge valve actuation duty and a purge valve operation delay time equivalent amount DLYWCG# (steps 121, 122 in FIG. 11).

3.4 Purge learning value updating

Figure 36:
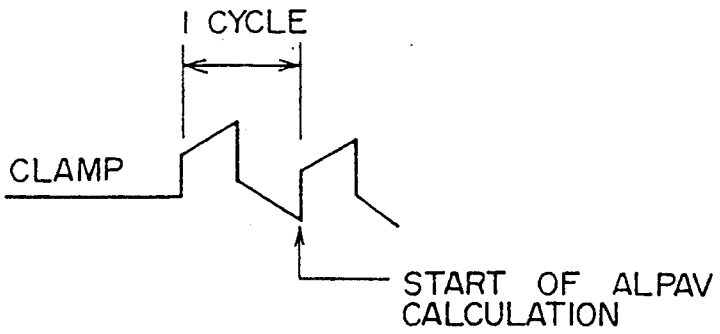
FIG. 36 is a waveform diagram showing the variation of AFR feedback correction coefficient $\alpha$ after the fuel injection controller releases a clamp.
Figure 43:
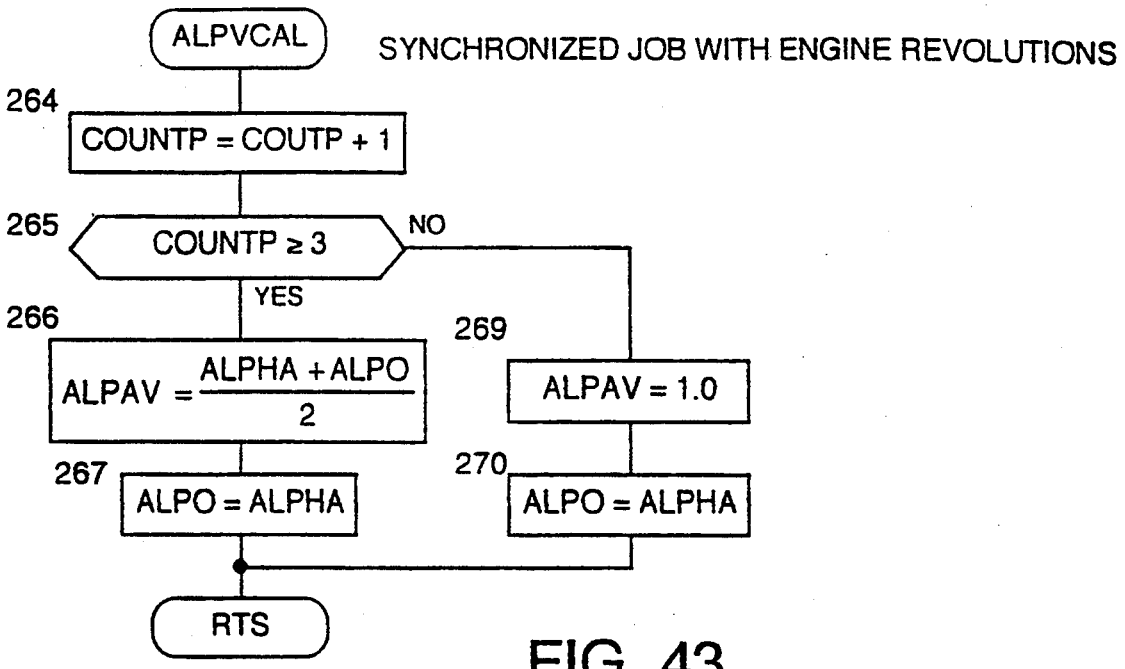
FIG. 43 is a flowchart showing the contents of a subroutine in FIG. 42.

The average value ALPAV of the initial AFR feedback correction coefficient when purge learning starts is stored in a memory ALPST (steps 131-133 in FIG. 12). The calculation of ALPAV is performed by a method known in the art which is often used for basic AFR learning, as shown in FIG. 43. In other words as shown by steps 263-268 in this flowchart, when the step amount P is added to the AFR feedback coefficient $\alpha$, ALPAV is given by the equation:

$$ALPAV=(ALPHA+ALPO)/2$$

where, ALPHA=present value of $\alpha$ ALPO=-preceding value of $\alpha$ immediately before adding the amount P However, if the AFR feedback coefficient $\alpha$ shifts from the clamped state to feedback control, the calculation of ALPAV is performed from the first control cycle after the clamp is released as shown in FIG. 36. Therefore, when the P addition count value (COUNTP) is less than 3, ALPAV is set equal to 0 (steps 265, 269 in FIG. 43). Of course, both ALPAV and ALPO are 1.0 when the AFR feedback control coefficient $\alpha$ is clamped (steps 261, 262 in FIG. 43). In this way, the value of ALPAV when learning starts is stored in ALPST. Also, the value of ALPAV when learning starts is the same as the value of ALPAV before there is a change-over between PURGE ON and PURGE OFF.

While purge learning is permitted, the purge learning value WC is updated by the following equation (step 181 in FIG. 13).

$$WC=\text{stored value of } WC+\Delta WC$$

The updated WC is limited between am upper limit (WCMAX#) and a lower limit (WCMIN#) (steps 183-185 in FIG. 13).

$\Delta$WC is a learning updating amount. Different values are assigned to it according to whether there is a large or small difference between the AFR correction coefficient $\alpha$ and ALPST, as shown in FIG. 34. This process is shown in FIG. 12 and FIG. 13 (if the difference is large, the values are $\pm$PWCH and $\pm$IWCH, while if the difference is small, the values are $\pm$PWCL and $\pm$IWCL).

Figure 35:
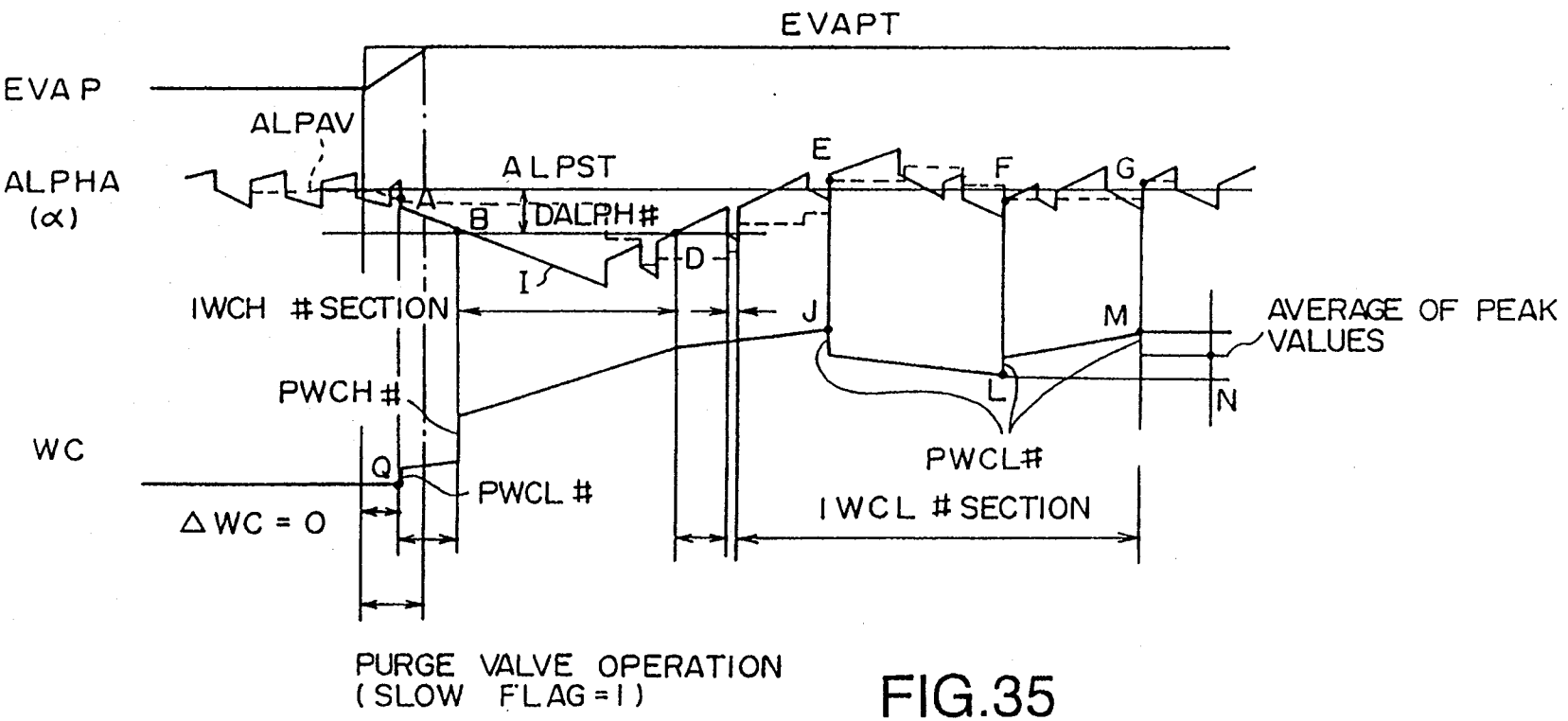

The waveform shown in FIG. 35 will be used instead of FIG. 12 and FIG. 13 to describe how the learning updating values $\Delta$WC are assigned.

FIG. 35 refers to the situation when there is a change-over to PURGE ON.

When $\alpha$ shifts to lean due to a change-over to PURGE ON, ALPAV, the average value of $\alpha$ (shown by a broken line) also shifts to lean. At a point A where ALPAV<ALPST, the learning value WC is increased stepwise by PWCL# (step amount), and is then increased gradually by IWCL# (integral amount).

If this processing is insufficient, $\alpha$ exceeds a predetermined range DALPH# at a point B and shifts further to the lean side, the learning value WC is increased stepwise by PWCH# (which is also a step amount) which has a greater value than the aforesaid PWCL#, and is then increased gradually by IWCH# (integral amount) which has a greater value than the aforesaid IWCL#. In this way, if $\alpha$ deviates from ALPST by an amount greater than DALPH#, the learning speed is increased by giving WC a larger step mount PWCH# or integral amount IWCH#.

In order to avoid overshoot of the learning value WC, addition (or subtraction) of the step amount PWCH# is performed only once while purge learning is permitted.

From a point D, at which the difference between $\alpha$ and ALPST is again within the predetermined range DALPH#, IWCL# is used, and from a point E at which ALPAV exceeds ALPST, small values PWCL# and IWCL# are used for both the step and integral amounts.

The difference between $\alpha$ and ALPST is calculated as $\Delta$ALP in a step 135 in FIG. 12. The judgment of whether or not $\Delta$ALP is within the predetermined range DALPH# is performed in steps 137, 145, 174 and 177.

3.5 Purge learning clap

When EVAP=EVAPT or EVAP=EVPCUT, the average value of the peaks of the two immediately preceding purge learning values WC is found. Subsequently, WC is clamped at this value, and purge learning is terminated. The peak value of the purge learning value WC is the value of WC just before PWCL# is added or subtracted.

Therefore, just before adding PWCL# to (or subtracting PWCL# from) $\Delta$WC in FIG. 13, the value in a memory OLDWC1 is transferred to a memory OLDWC2, and the value in a memory WC is transferred to the memory OLDWC1. A PWCL addition count value CONTPWCL is then increased by 1 (steps 155, 158, steps 164, 166). When the count value CONTPWCL exceeds a predetermined value NSWCGK# (e.g. 3), it is judged that the learning value has converged, the value of (OLDWC1+OLDWC2)2 is substituted in WC (steps 125, 126 in FIG. 11), and the purge learning permission flag is set equal to 0 (step 128).

The reason why the purge learning value WC is clamped in this way is as follows. AFR control precision is increased by separating the purge learning value WC from the basic AFR learning value $\alpha m$, hence it is desirable to terminate purge learning quickly. If purge learning were carried out for prolonged periods, variations of $\alpha$ due to change of running conditions would come into purge learning as errors. In other words, it is desirable to terminate purge learning within a short time interval during which the running conditions do not change, and to eliminate AFR errors due to change of running conditions at times other than change-over between PURGE ON and PURGE OFF by basic AFR learning.

Also, at a point Q in FIG. 35, as the amount PWCL# is added during the purge valve change-over (slow flag=1), it is not counted in the PWCL addition count value (CONTPWCL) (steps 124, 130 in FIG. 11).

4. Purge Valve actuation Duty Learning

Figure 37:
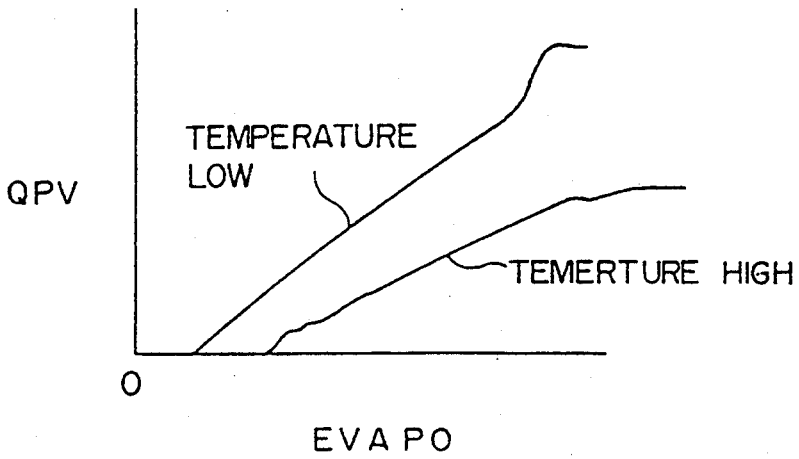
FIG. 37 is graph showing general flowrate characteristics of a purge valve driven by a linear solenoid.

As shown in FIG. 37, the purge valve actuation duty (duty when the purge valve begins to open) of the purge valve 21 driven by the linear solenoid, has a scatter due to temperature dependence. This scatter largely affects the purge rate in the small flowrate region. For example the opening of the purge valve becomes more difficult the higher the temperature, therefore the real purge rate becomes smaller for higher temperature even for the same basic duty EVPO.

A learning value corresponding to the purge valve actuation duty (referred to hereinafter as an offset learning value) OFSTPV is therefore introduced separately from the purge learning value WC.

In FIG. 37, the purge valve flowrate varies linearly with the ON duty, and its slope is considered to be effectively constant. If this line is considered to undergo a parallel shift depending on the temperature, we may write:

Target duty=Basic duty+Purge valve actuation duty

Assume that there are no AFR errors due to other causes, that the purge valve temperature increases from a state wherein offset learning has been performed at least once, and that the purge valve actuation duty has increased. In this case, the opening of the purge valve is delayed due to the temperature rise, the purge valve flowrate decreases, and the purge rate falls. Due to the fall of purge rate, the AFR tends to lean, and to restore it to rich, $\alpha$ and the average value of $\alpha$ (ALPAV) become greater than the control center value (1.0).

Therefore if, when $\alpha$ has shifted to a higher value, the offset learning value OFSTPV is updated to a higher value, the purge valve flowrate will be restored to what it was before the temperature rise. This updated leaning value corresponds to the purge valve actuation duty after temperature rise.

Conversely, if the purge valve opens more quickly due to a fall of purge valve temperature, the purge valve flowrate increases and the AFR tends to rich, so $\alpha$ and ALPAV are shifted to below the control center value. In this case the offset leaning value OFSTPV is updated to a smaller value so as to restore the purge valve flowrate to what it was before the temperature drop. This updated learning value is identical to the purge valve actuation duty after temperature drop.

The concepts of offset learning and purge learning are therefore exactly the same, the differences between the two residing only in the fact that the names of constants and parameters are different, and the fact that the direction of updating learning values is reversed. Herein, therefore, these differences will be discussed in simple terms.

4.1 Offset learning permission conditions

Offset learning is also permitted when there is a change-over to PURGE ON or PURGE OFF, but offset learning is reserved for after the purge learning value WC is clamped (steps 126, 127 in FIG. 11). This is done to separate the AFR error due to purge which is corrected by the learning value WC, and the AFR error due to purge valve actuation scatter which is corrected by the learning value OFSTPV.

Figure 33:
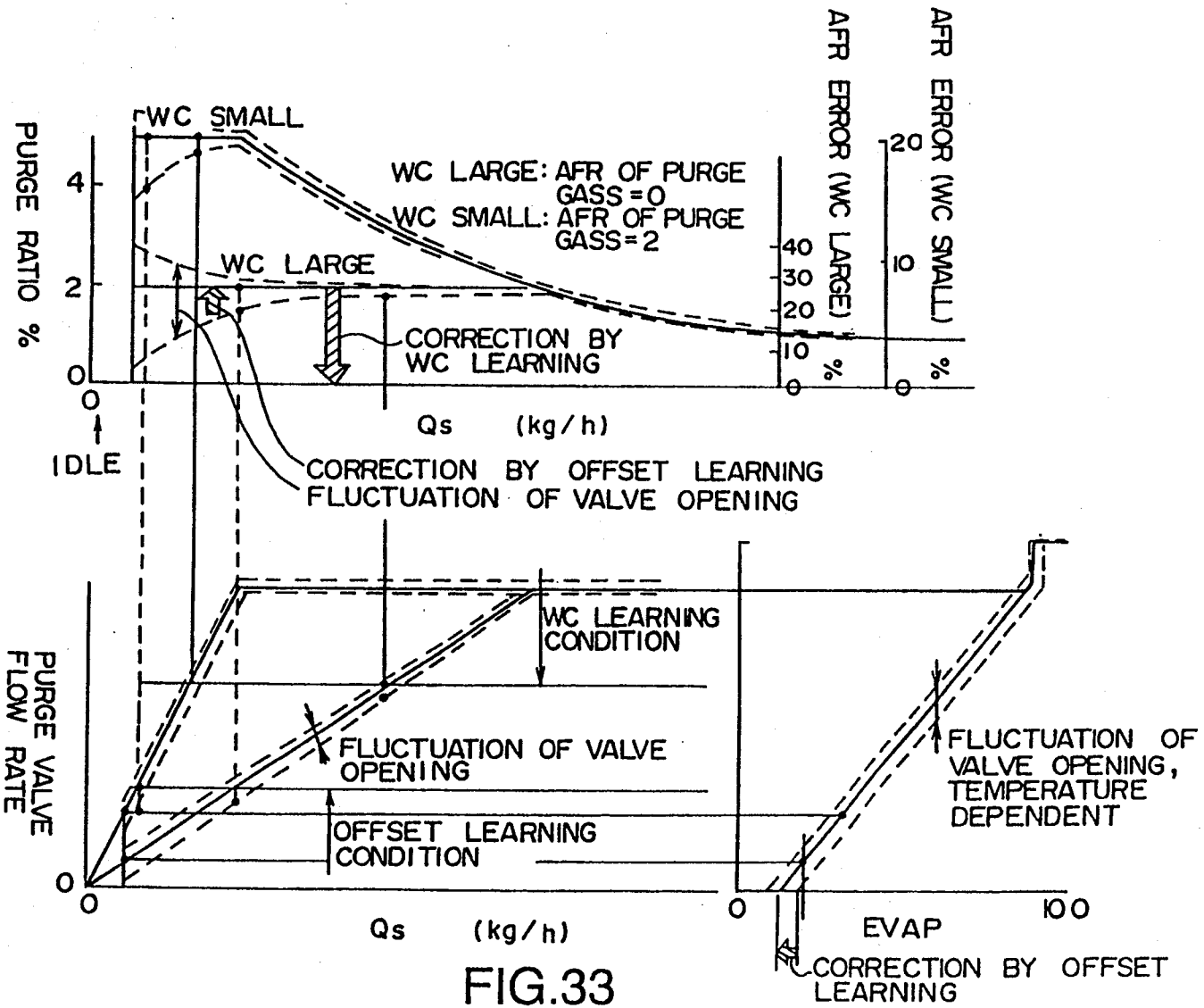
FIG. 33 is a graph showing the variation of purge valve flowrate and purge rate by a purge valve control according to in this invention.

As shown in FIG. 33, when the scatter of purge valve actuation characteristics due to temperature is superimposed on the graph of purge rate characteristics (solid line), the broken lines in the figure are obtained, and the scatter of purge rate in the low flowrate region rapidly increases. This is because if there is a constant temperature difference, the scatter of the purge valve flowrate is effectively constant irrespective of the purge valve duty as shown in FIG. 37. Therefore, in terms of purge rate, the proportion of scatter is larger the smaller the air flow meter flowrate Qs.

Purge learning is therefore first performed in the high flowrate region which is not affected by this scatter so as to remove AFR error due to purge, and then offset learning is performed in the low flowrate region where scatter is large so as to remove AFR error due to scatter of the purge valve actuation duty of the purge valve 21.

In a wider sense, the offset learning value is also a purge learning value.

4.2 Offset learning interruption conditions

Figure 14:
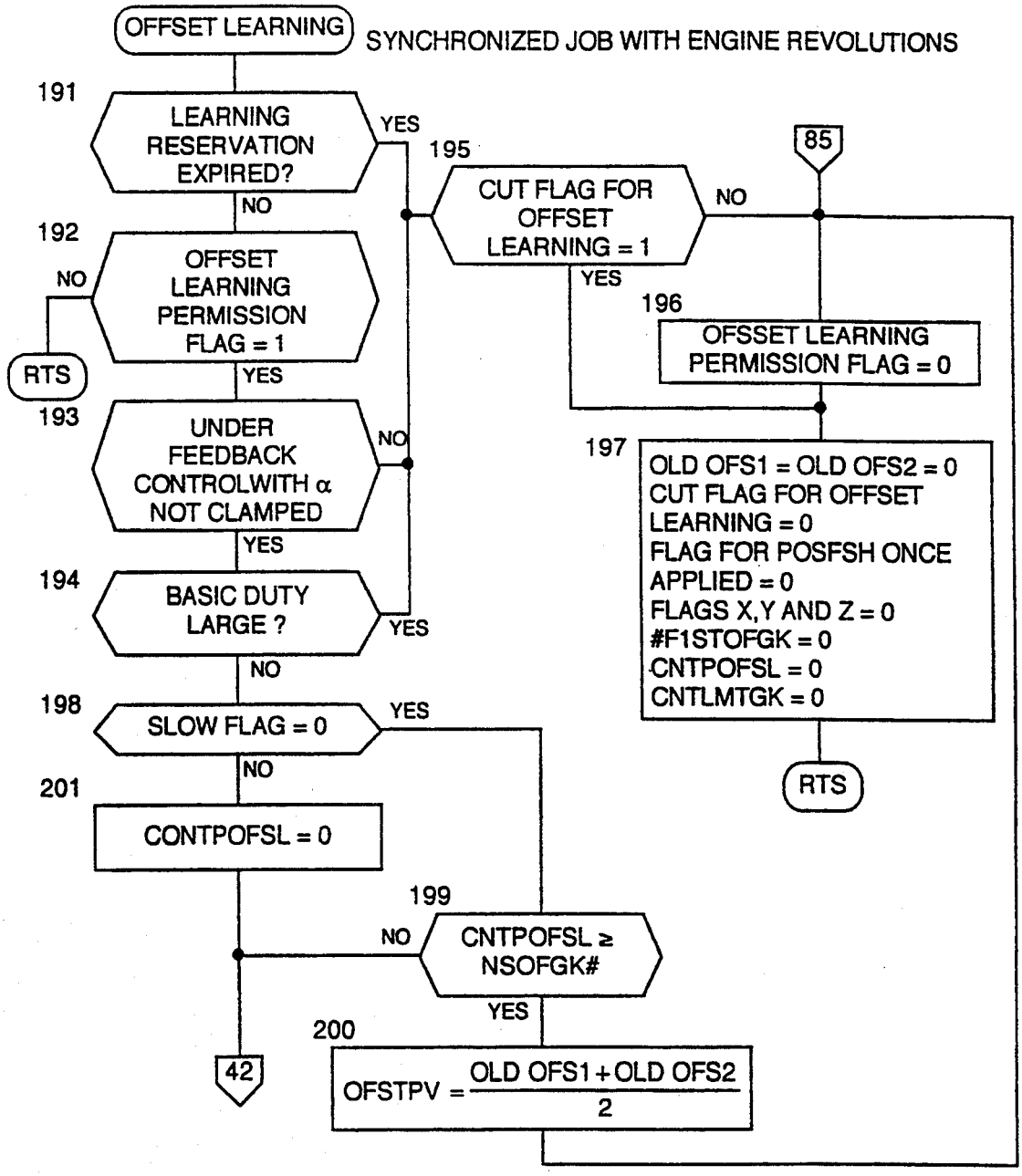
FIG. 14–FIG. 16 are flowcharts showing the process of offset learning according to this invention.
Figure 15:
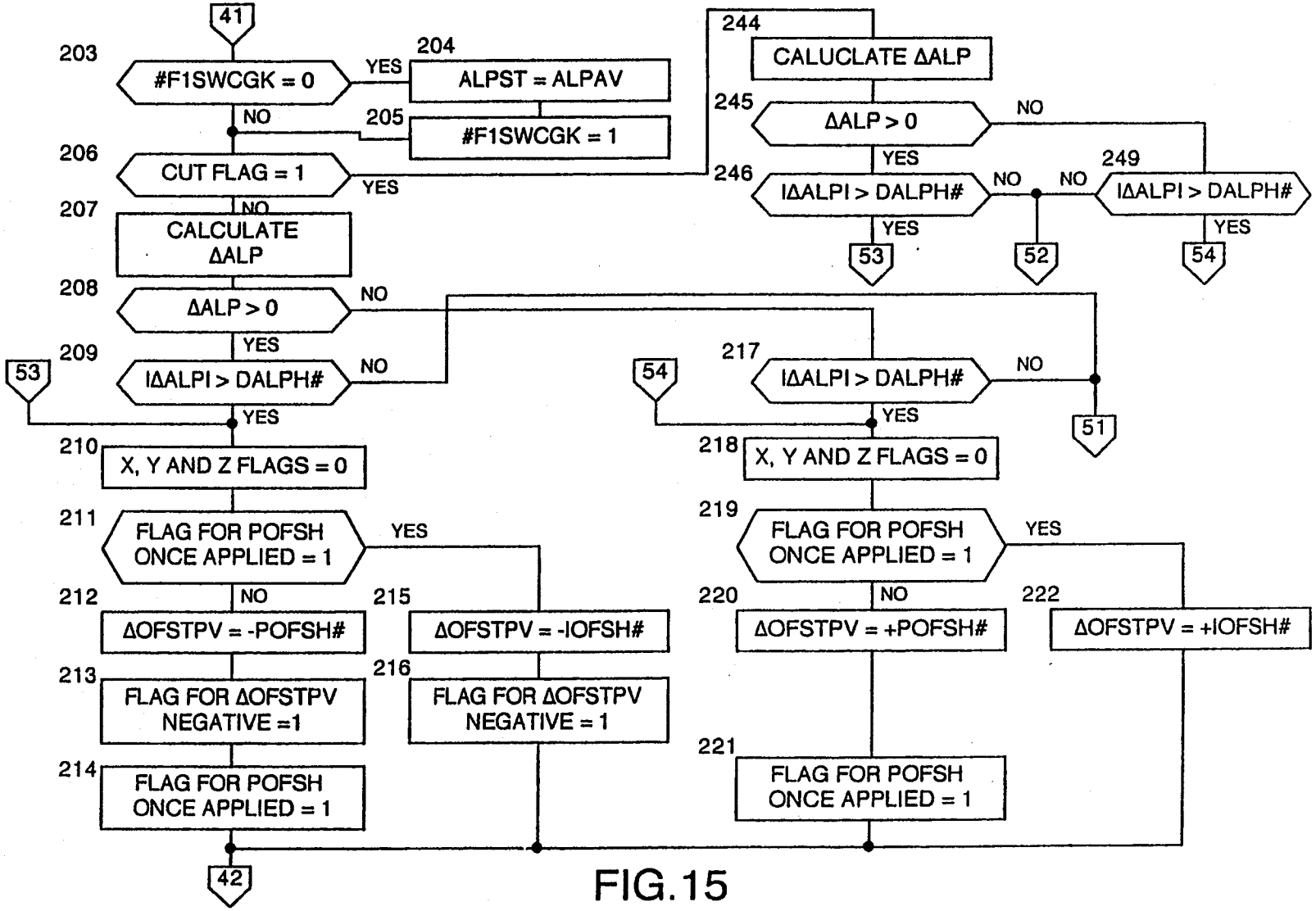
Figure 16:
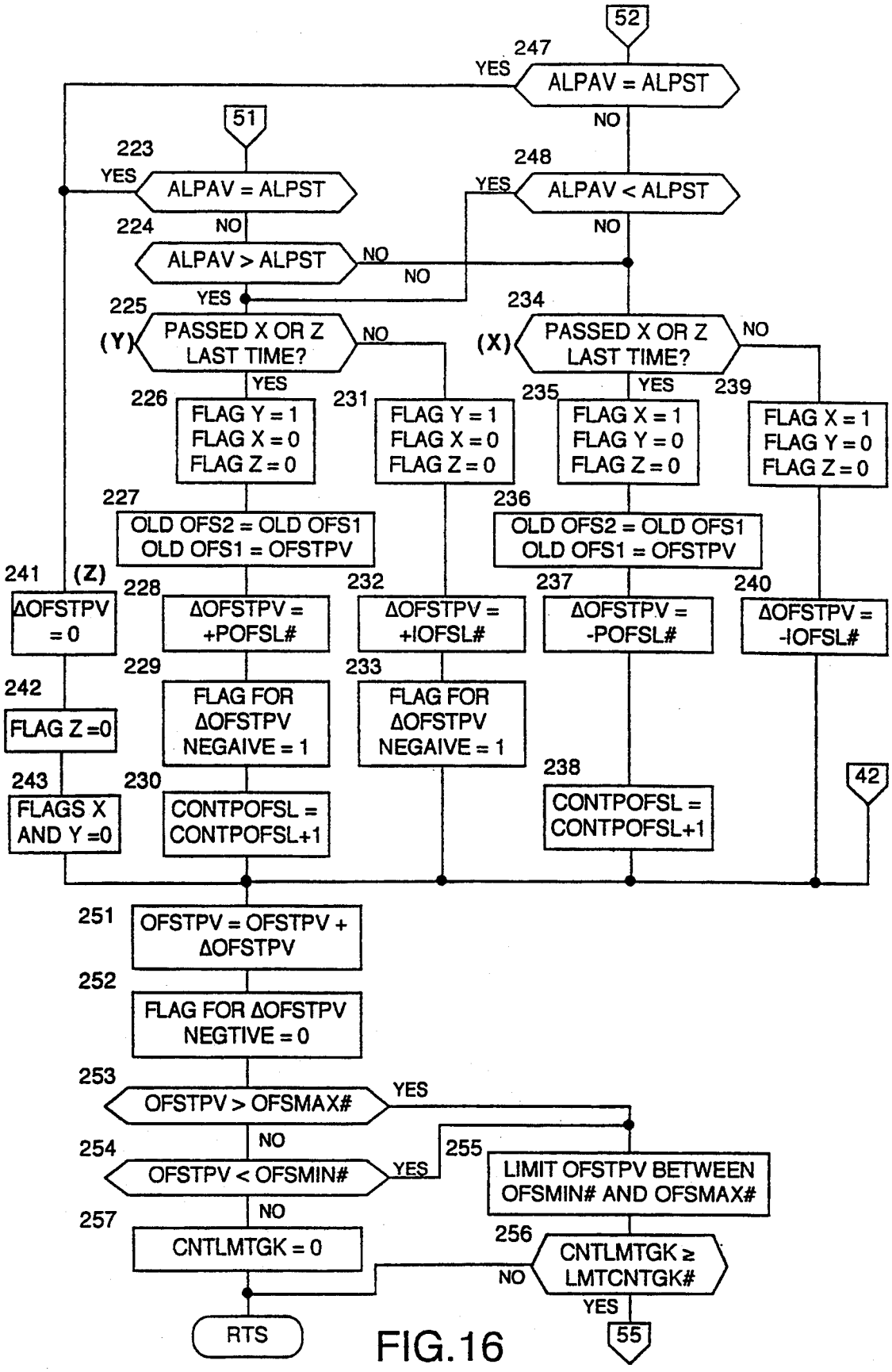

In offset learning, if the basic duty EVAPO is greater than a predetermined value OFGDTY#, learning is interrupted (steps 194, 196 in FIG. 14). In other words, offset learning is performed when EVAPO is small. On the other hand, as shown in step 118 in FIG. 11, purge learning is performed only if EVAPO is large.

4.3 Learning value updating

Figure 39:
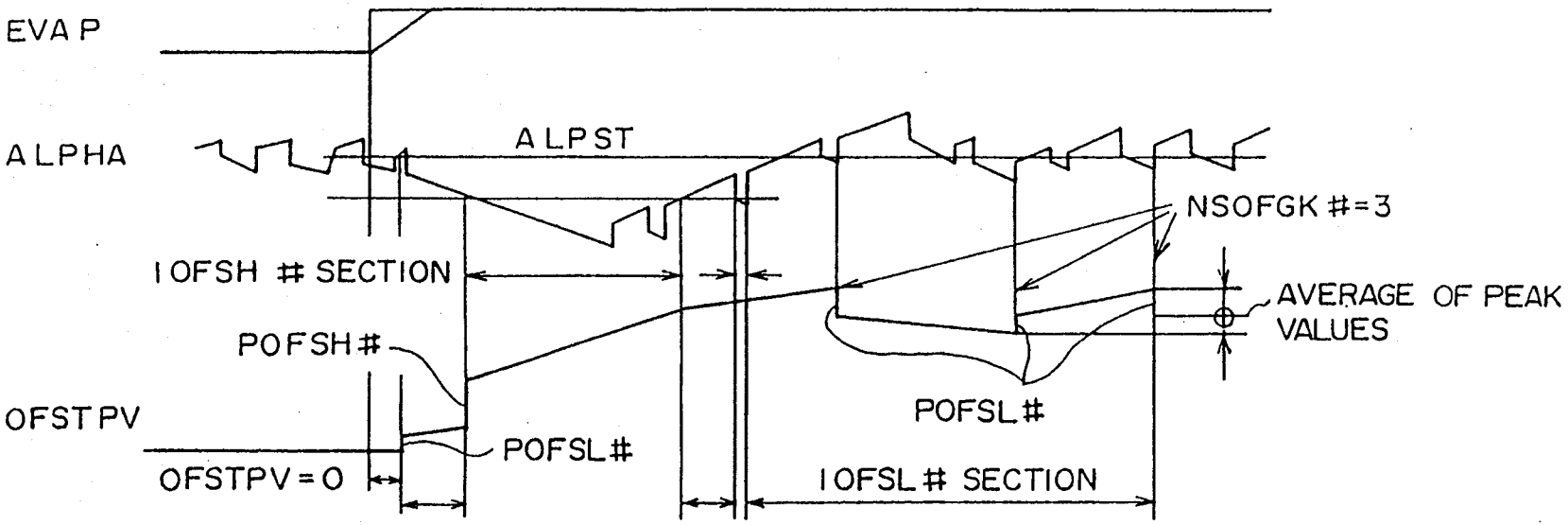

As cam be seen by comparing FIG. 38 and FIG. 34, the attachment of a positive or negative sign to the learning updating value $\Delta$OFSTPV is opposite to that for $\Delta$WC. The variation of the learning value OFSTPV when there is a change-over to PURGE ON is therefore as shown in FIG. 39. In this figure, OFSTPV is negative in the upper region and positive in the lower region.

5. Basic AFR Learning

Figure 17:
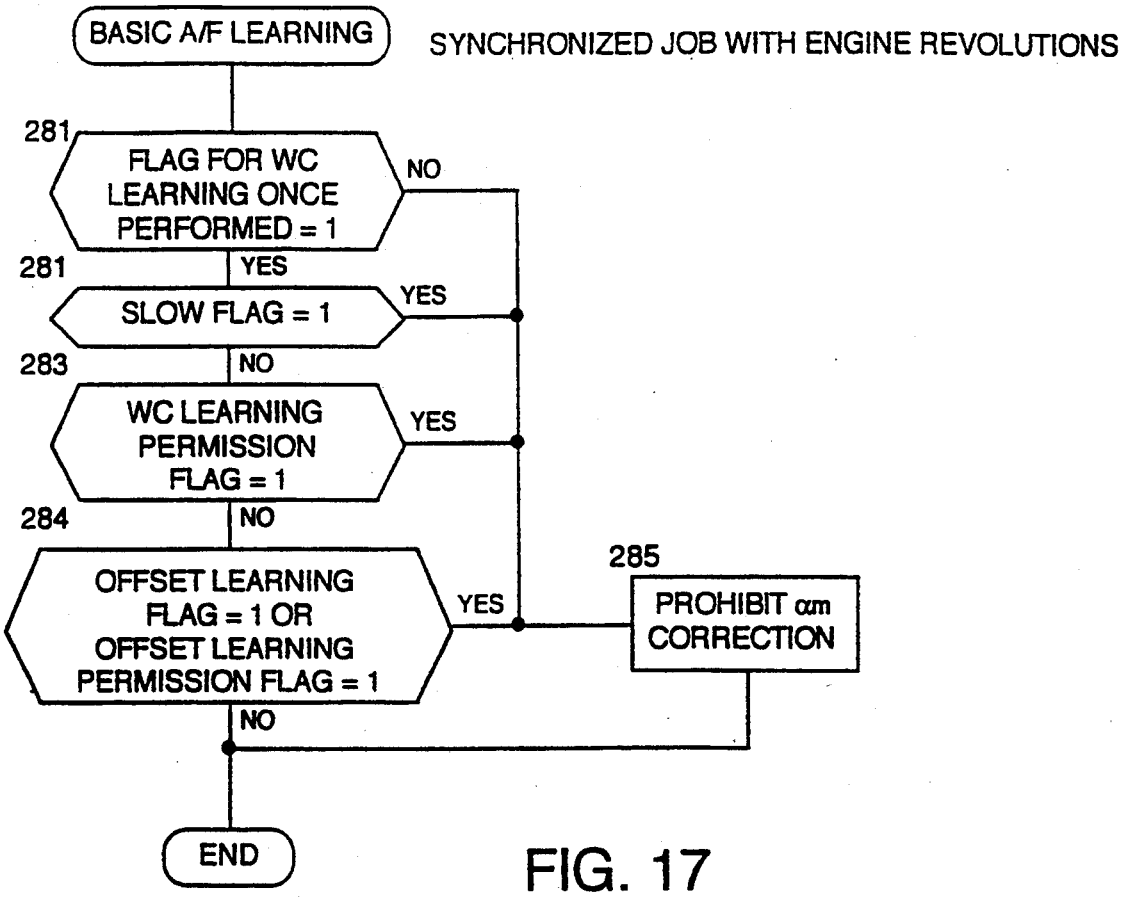
FIG. 17 is a flowchart showing the process of determining the conditions for prohibiting the updating of basic AFR learning values according to this invention.

The basic AFR learning process is shown in FIG. 17.

5.1 Learning prohibition conditions

If any of the following conditions are satisfied, the basic AFR learning value $\alpha m$ is not updated (steps 281–284, 285 in FIG. 17).

(i) Purge learning has not yet been performed (step 281).

(ii) The slow flag=1 (step 282).

This is when there is a change-over to PURGE ON or to PURGE OFF.

(iii) The purge learning permission flag=1 (step 283).

(iv) The offset learning reservation flag=1 or the offset learning permission flag=1 (step 284).

The reason why basic AFR learning is prohibited not only during purge as in (ii), but also during purge learning and offset learning as in (iii) and (iv), is to prevent AFR error due to purge gas which has a relatively fast time variation from affecting AFR error which has an extremely slow variation (due to scatter in the characteristics of the air flow meter or injector) for which purpose αm was introduced.

The basic learning AFR αm is of course updated by:

$$\alpha m = \text{storage value of } \alpha m + \Delta\alpha m$$

where, Δαm=learning updating amount, and the learning updating amount is calculated by:

$$\Delta\alpha m = (ALPAV - 1.0) \cdot GAIN$$

where, ALPAV=average value of ALPHA GAiN-=updating proportion (value less than or equal to 1)

6. Fuel injection Pulse Width Characteristic Equation 6.1 Fuel injection pulse width A fuel injection pulse width CTin for each cylinder is calculated by the following equation (step 323 in FIG. 20):

$$CTIn = TI + CHOSn + ERACIn \quad (11)$$

where, n=injector number

Ti=common fuel injection pulse width for all cylinders

CHOSn=increase or decrease for each cylinder

ERACIn=pulse width shifted from interrupted injection to synchronous injection

This equation is known in the art.

The fuel injection pulse width TI in equation (11) is calculated by the following equation (step 322 in FIG. 20):

$$TI = (TP - TEFC + KATHOS) \cdot TFBYA \cdot (\alpha + \alpha m) + Ts \quad (12)$$

for simultaneous injection, and:

$$TI = (TP - TEFC + KATHOS) \cdot TFBYA \cdot (\alpha + \alpha m) \cdot 2 + Ts \quad (13)$$

for sequential injection, where, TP=pulse width corresponding to cylinder air volume TEFC=pulse width corresponding to purged fuel KATHOS=wall flow correction amount TFBYA=target AFR α=AFR feedback correction coefficient αm=basic AFR learning value Ts=ineffectual pulse width The difference from the prior art resides in the fact that in equations (12) and (13), TEFC is subtracted from TP. When purge gas is introduced into the intake air pipe, a surplus fuel quantity TEFC in the purge gas enters the cylinder. However, to maintain the same AFR as when purge is not carried out, this purge gas fuel amount is subtracted from the fuel amount supplied to each cylinder from the injector 8.

The pulse width corresponding to the cylinder air volume TP is found in the same way as in the prior art (steps 312, 313 in FIG. 20), i.e.:

$$TPO = Qs \cdot KCONST\# \cdot KTRM / NE \quad (14)$$

$$TP = TPO \cdot FLOAD + TP \cdot (1 - FLOAD)$$

where, TPO=pulse width corresponding to air volume of air flow meter

Qs=air volume of air flow meter

KCONST#=construct

KTRM=trimming coefficient used for correcting air volume error

NE=engine rotation speed

FLOAD=weighting average coefficient

These equations are also known in the art, and are used for phase adjustment to correspond with file cylinder intake timing.

6.2 Purge fuel equivalent pulse width

The pulse width corresponding to the purge fuel TEFC is found from the following equation (step 311 in FIG. 20):

$$TEFC = QEFC \cdot KCONST\# / NE \quad (16)$$

where, QEFC=prediction value of cylinder purge fuel intake

KCONST#=constant

NE=engine rotation speed

Equation (16) is the same type of equation as equation (14), and performs a unit conversion of the prediction value of cylinder purge fuel intake QEFC to an injection pulse width.

The prediction value of cylinder purge fuel intake QEFC is expressed as a series combination of two first order delays (weighting averages)with respect to the purge fuel flowrate (QEF)+dead time. In other words:

$$QEF1 = QEF \cdot EDMP1\# + QEF1 \cdot (1 - EDMPI\#) \quad (17)$$

$$QEF2 = QEF \cdot EDMP2\# + QEF2 \cdot (1 - EDMP2\#) \quad (18)$$

where, QEF1=intermediate prediction value of purge fuel flowrate

EDMP1 #=weighting average coefficient 1

QEF2=intermediate prediction value of purge fuel flowrate

EDMP2#=weighting average coefficient 2

Figure 18:
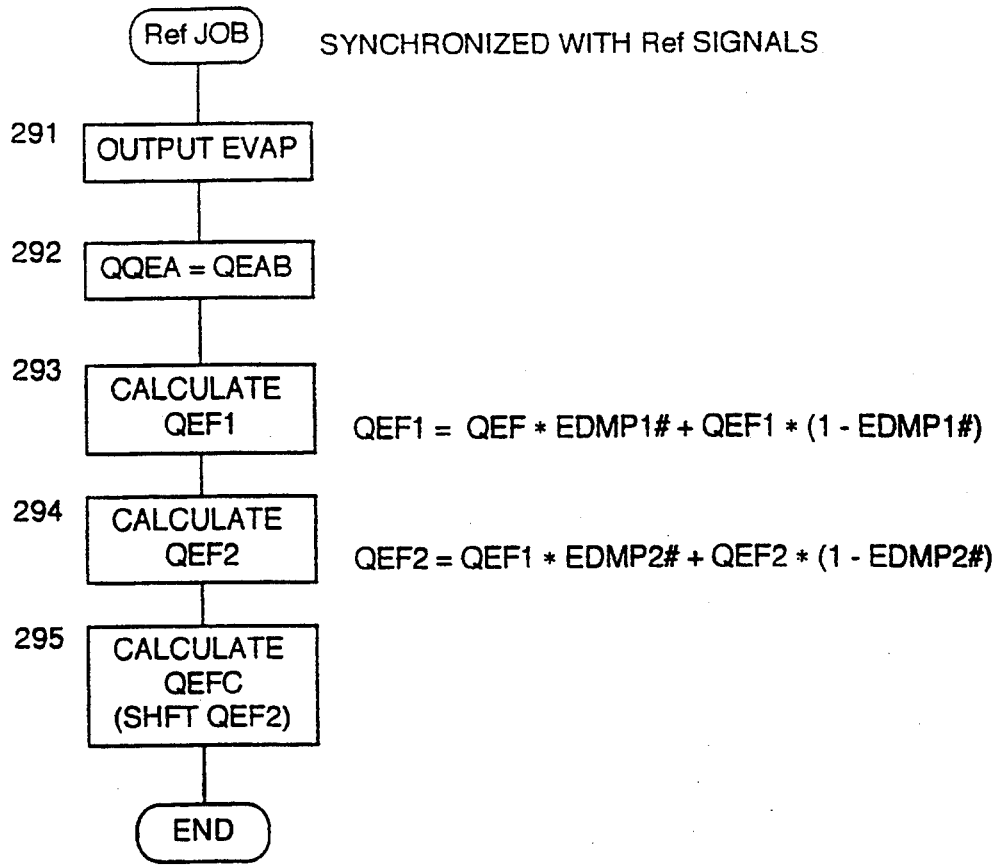
FIG. 18 is a flowchart showing the process of calculating a prediction value QEFC of a purge fuel cylinder intake amount according to this invention.

The value obtained by delaying QEF2 by a predetermined number (QEFDLY#) of Ref signals (generated every 180° for 4 cylinders, and every 120° for 6 cylinders), is QEFC (steps 293–295 in FIG. 18). This may be explained as follows.

Figure 40:
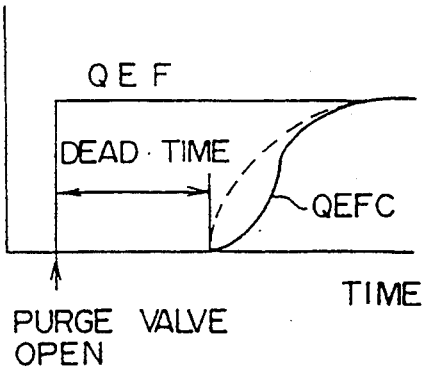
FIG. 40 is a graph showing the characteristics of a purge fuel cylinder intake amount prediction value QEFC found by the fuel injection controller.

The purge fuel flowrate QEF entering the intake air pipe from the purge valve (fuel alone) has a dead time (simple time delay) until it reaches the cylinder, and the fuel vapor diffuses as it is passes along. The waveform of QEFC may therefore be represented as shown in FIG. 40.

If a certain number of memories are prepared to store calculated values of QEF2, and the value of QEF2 is progressively shifted to an adjacent memory, the value of QEF2 corresponding to the preceding number of times QEFDLY# may be set equal to QEFC (step 295 in FIG. 18).

The purge fuel flowrate QEF of equation (17) may be calculated by the following equation (step 21 in FIG. 5):

$$QEF = WC \cdot QPV \cdot KQPV \quad (19)$$

where, WC=purge learning value QPV=purge valve flowrate prediction value KQPV=purge valve flowrate correction factor Thus, by multiplying the prediction value of the purge valve flowrate QPV by the value WC corresponding to the fuel concentration of the purge gas, QEF, the purge fuel amount, can be found.

Figure 5:
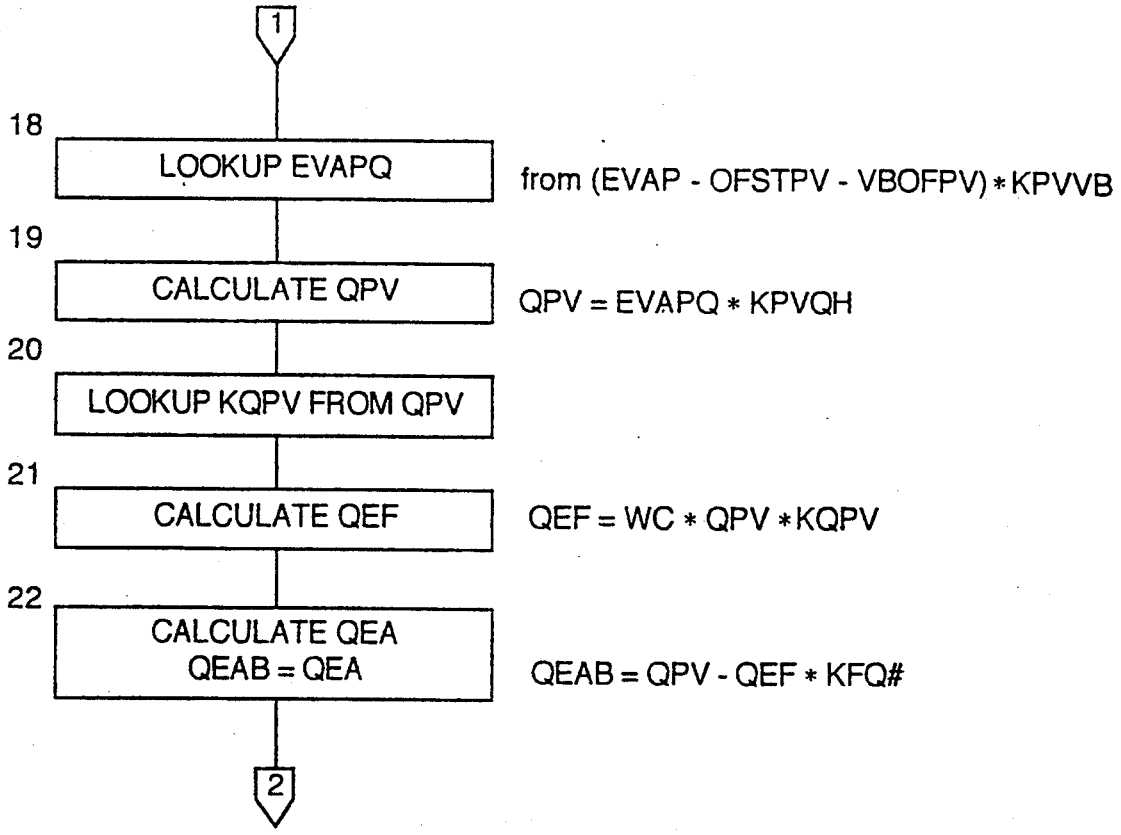
Figure 29:
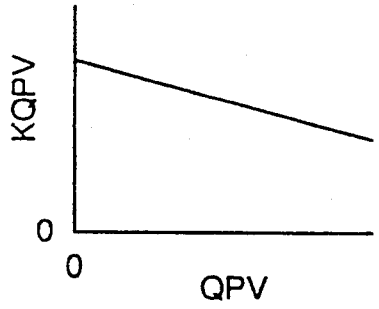
FIG. 29 is a graph showing a table of purge fuel flowrate correction rates KQPV provided in the fuel injection controller.

The flowrate correction factor KQPV in equation (19) is found from the prediction value of purge valve flowrate QPV by looking up a table of the characteristics shown in FIG. 29 (step 20 in FIG. 5).

7. Intake Air Volume

When purge is carried out, the air volume Q used in calculating the injection amount is given by:

$$Q=Qs+QEA \quad (20)$$

where, Qs=mr volume of air flow meter QEA=-purge air flowrate (excluding fuel amount)

Figure 19:
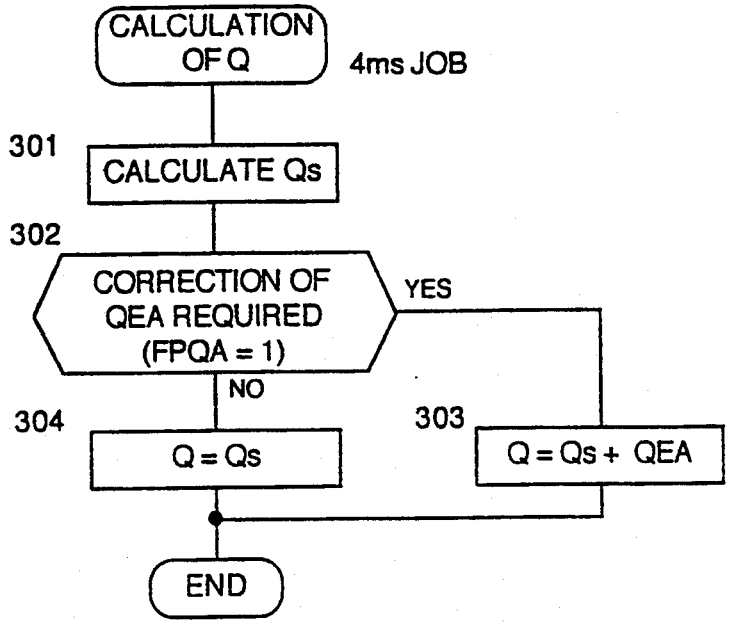
FIG. 19 is a flowchart showing the process of calculating an air amount Q according to this invention.

Herein, if an artificial selection flag FPQA=1, the air volume is corrected by a purge air amount using equation (20), and if FPQA=0, no correction is made (steps 302, 303, and steps 302, 304 in FIG. 19).

The reason why equation (20) is used during purge, is that as the air volume entering the intake air manifold 17 from the purge valve 21 is not measured by the upstream air flow meter 7, an AFR lean error is produced by the additional air volume due to purge. During purge, therefore, this lean error is prevented by using Q in equation (20). This purge includes the case where air alone enters without any fuel adsorbed in the active carbon canister 16. There is also a measurement delay in the air flow meter 7, but this can be dealt with as disclosed in Tokkai Hei 3-222849 published by the Japanese Patent Office.

The purge air flowrate QEA in equation (20) can be calculated by:

$$QEA=QPV-QEF\cdot KFQ\# \quad (21)$$

where, QPV=purge gas flowrate (air+fuel) QEF=-purged fuel flowrate KFQ# =factor for correcting fuel flowrate to air flowrate As QEA is synchronized with the EVAP (purge valve duty) output executed by a Ref signal job (step 291 in FIG. 18), the value of QEA found by a background job is temporarily stored in a memory QEAB (step 22 in FIG. 5), and the value of QEAB is then transferred to a memory QEA by the Ref signal job (step 292 in FIG. 18).

The air flowrate and final vapor flowrate are different although the flowpath is the same, and KFQ# in equation (21) corrects for this difference.

8. Wall flow correction

When the vehicle accelerates, the injection amount must be increased. No matter how good the fuel injection characteristics of the injector may be, however, part of the fuel adheres to the air intake manifold wall. This fuel flows as a liquid down the wall of the air intake pipe, and enters the cylinder at a slower speed than the fuel mixed with air. In other words, due to wall flow, the gas mixture entering the cylinder temporarily becomes thinner. In order to prevent this temporary thinning of the gas mixture, the fuel amount is increased by a wall flow correction amount KATHOS during acceleration. Conversely, during deceleration, the manifold pressure suddenly reverts to a high negative pressure. In this case the fuel adhering to the manifold wall is immediately vaporized, the gas mixture temporarily becomes too concentrated, and CO, HC increase. During deceleration, therefore, this vaporized wall flow amount is subtracted from the fuel amount.

Insofar as concerns wall flow correction, a controller which aims to correct the low frequency component of wall flow (the wall flow component which varies relatively slowly) is disclosed in Tokkai Sho 63-38656 and Tokkai Sho 63-38650 published by the Japanese Patent Office. In this controller, a steady state adhesion amount (MFH) is memorized for each running condition of the vehicle. Under transient conditions, the variation of this steady state adhesion amount is added to (or for deceleration, subtracted from) the pulse width TP corresponding to the cylinder air volume in predetermined proportions for each fuel injection as a total correction amount (KATHOS).

Further, a controller which aims to correct the high frequency component of wall flow (the wall flow component which varies relatively quickly), is disclosed in Tokkai 3-111639 published by the Japanese Patent Office. In this controller, the wall flow accompanying the variation of air volume is calculated by introducing the concepts of an increase/decrease correction amount CHOSn for each cylinder, an interruption injection amount INJSETn for each cylinder, and an over-injection correction amount ERACIn for each cylinder.

However, the fuel vapor in the purge gas which evaporates from the fuel tank 15 is a light fuel composed mainly of volathe constituents such as butane, and as they are almost entirely present as vapor even in the intake air pipe, they do not set up a wall flow. In calculating the wall flow correction amount KATHOS, therefore, the purge fuel amount (TEFC) must be removed from consideration.

When purge is performed, the steady state adhesion amount MFH is calculated by:

$$MFH=MFHTVO\cdot CYLINDR\#\cdot(TP - TEFC) \quad (22)$$

where, MFHTVO=adhesion factor

CYLINDR#=number of cylinders

TP=pulse width corresponding to cylinder air volume

TEFC=pulse width corresponding to purge fuel

In other words, by subtracting from TP the fuel amount TEFC which does not give rise to wall flow, the prediction precision of the wall flow correction amount KATHOS is improved and the AFR under transient conditions can be given a more suitable value.

However, there are some engines wherein a wall flow correction amount is not introduced. In these cases, when an artificial selection flag FPFHL=1, equation (22) is used (steps 315, 316 in FIG. 20).

Figure 20:
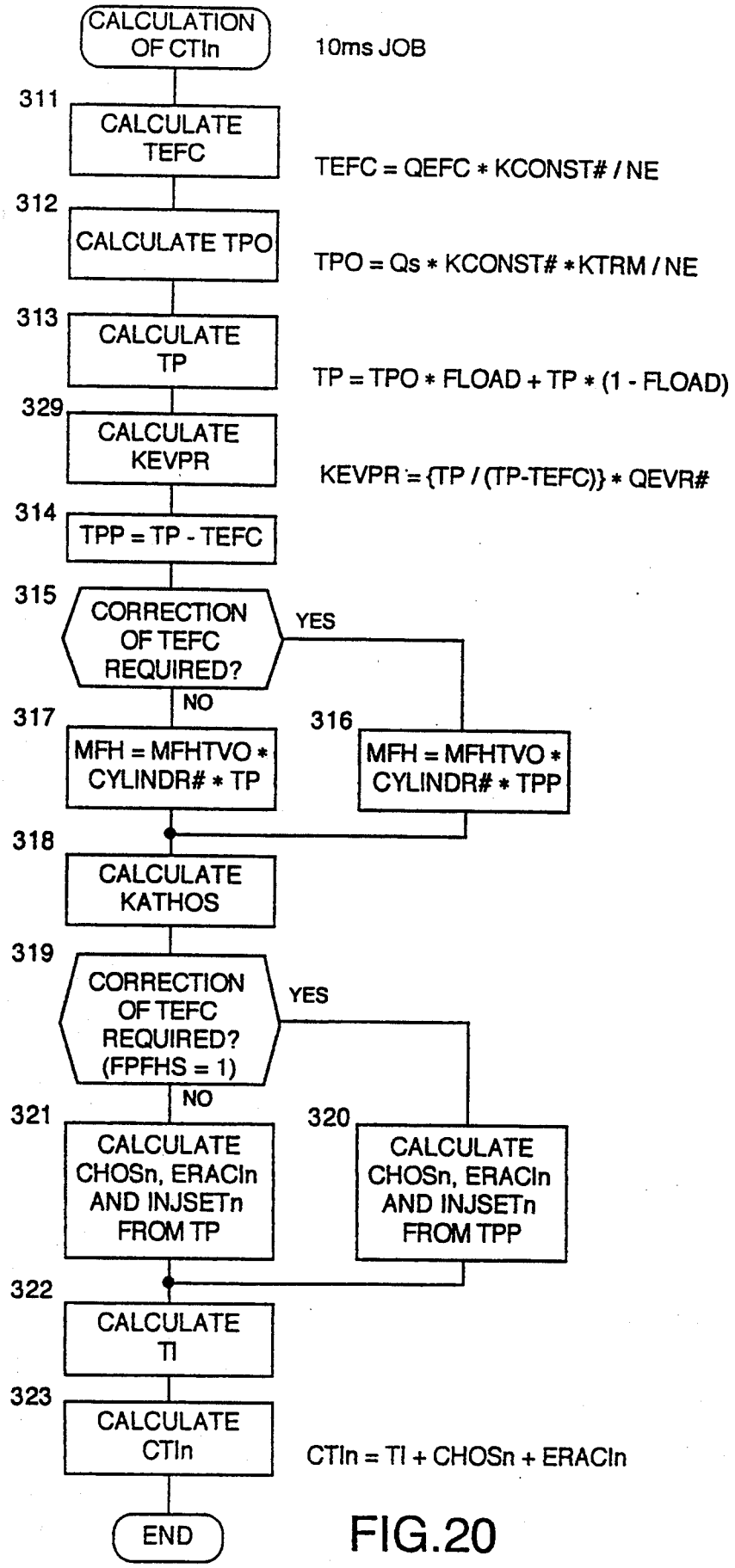
FIG. 20 is a flowchart showing the process of calculating an injection pulse width CTIn according to this invention.

When FPFHL=0, MFH is calculated by:

$$MFH=MFHTVO\cdot CYLINDR\#\cdot TP$$

as in the prior art (steps 315–318 in FIG. 20). Hence, the situation can be adapted to both types of engine.

Similarly, in the case of CHOSn, INJSETn and ERACIn, a common fuel injection pulse width TI for all cylinders is calculated by writing the pulse width corresponding to the cylinder air volume by TP - TEFC=TPP when the artificial selection flag FPFHS =1, and by TP as in the prior art when FPFHS=0 (steps 319, 320, and steps 319, 321 in FIG. 20).

9. Idle rotation speed control

When purge air is taken into the engine, the output torque increases. In other words, the output largely varies on low load even for the same accelerator depression due to change-over between PURGE ON and PURGE OFF, and the running characteristics of the vehicle are adversely affected.

In this case, if an auxiliary air valve whereof the opening can be continuously varied according to a duty signal is provided in a passage by-passing the throttle valve 6, and this auxiliary air valve is throttled as purge air is introduced, impairment of running conditions can be prevented. This auxiliary valve provides control when the engine is running idle, i.e. when the accelerator is not depressed.

Therefore, when an artificial selection flag FEVISC=1, an auxiliary valve control duty ISCON may be calculated by the following equation (steps 324, 326 in FIG. 21):

$$ISCON = \text{previous } ISCON - ISCEVP \quad (23)$$

where, ISCEVP=purge correction factor

If on the other hand FEVISC=0, ISCON is given by the following relation (steps 324, 327 in FIG. 21):

$$ISCON = \text{previous } ISCON$$

Figure 21:
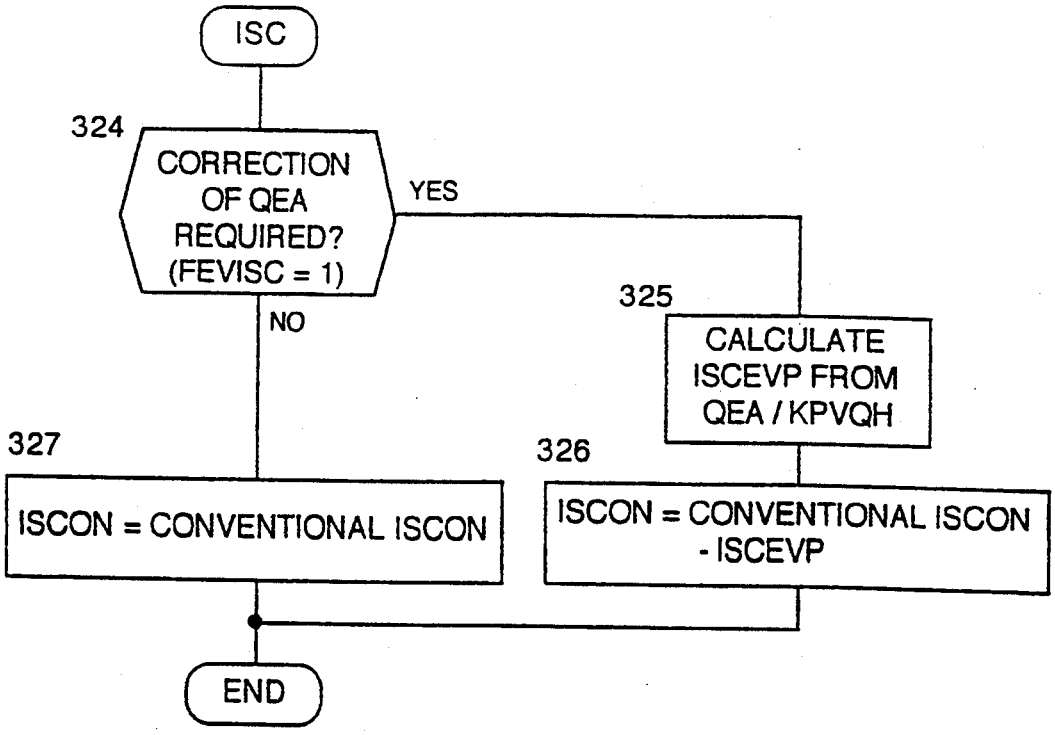
FIG. 21 is a flowchart showing the process of calculating a control duty ISCON of an auxiliary air control valve according to this invention.
Figure 41:
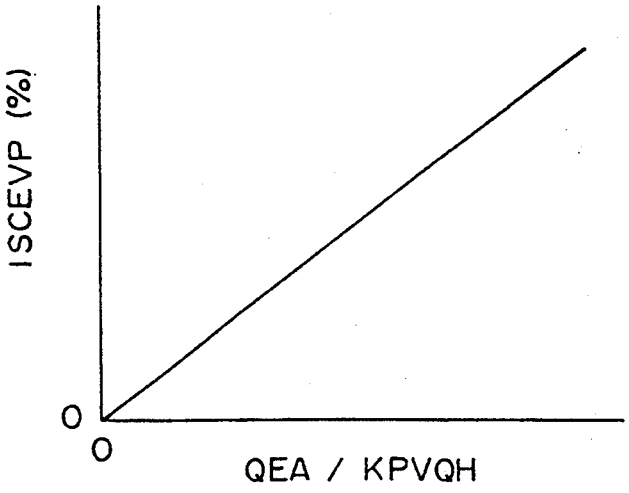
FIG. 41 is a graph showing a table of purge correction amounts ISCEVP prodded in the fuel injection controller.

The purge correction factor ISCEVP in equation (23) is found from QEA/KPVQH by looking up a table of the characteristics shown in FIG. 41 (step 325 in FIG. 21).

The previous ISCON in equation (23) is given for example by:

$$ISCON = ISCi + ISCp + ISCtr + ISCat + ISCa + ISCrfn \quad (24)$$

where, ISCi=idle feedback control integral

ISCp=idle feedback control differential

ISCtr=air increase amount during deceleration

ISCat=D range correction of automatic transmission vehicle

ISCa=correction when air conditioner is ON

ISCrfn=correction when radiator fan is ON

This completes the description of each part of the control system.

The action of the controller 2 according to the aforesaid construction will now be described.

Once the purge gas fuel concentration is predicted by the purge learning value WC (FIG. 11–FIG. 13), and the purge valve flowrate prediction value QPV is calculated according to the running conditions (step 19 in FIG. 5), the purge fuel flowrate QEF is then found from the previous equation (19) (step 21).

As the AFR tends to become rich when an excessively high purge fuel flowrate QEF enters the cylinder, the variation of AFR before and after purge can be suppressed by giving the injector 8 a value TP - TEF, obtained by subtracting the purge fuel flowrate TEF from the cylinder air volume equivalent pulse width TP. QEF is converted to an injector pulse width by:

$$TEF = QEF \cdot KCONST\#/NE$$

and the converted value TEF is then subtracted from TP.

In practice, a purge fuel cylinder intake prediction value J is calculated from QEF taking account of the fact that the purge fuel flowrate QEF has a simple time delay until it reaches the cylinder, and that the fuel vapor diffuses as it passes along (steps 293, 294 in FIG. 18), and this is converted to an injector pulse width TEFC from equation (16) as described hereintofore.

The variation of AFR is further suppressed by subtracting this converted value TEFC from TP (steps 311, 314 in FIG. 20).

However, if the purge fuel concentration mid the purge rate are too high, and the proportion of the purge fuel flowrate equivalent value TEFC is too large relative to the basic injection equivalent value TP, the feedback proportion effectively becomes smaller than the required value, the control period of $\alpha$ becomes too long, and the AFR drifts outside the catalyst window.

To deal with this, the controller 2 calculates a purge correction factor KEVPR from the following equation (step 329 in FIG. 20):

$$KEPVR = (TP/TP - TEFC) \cdot QEVPR\# \quad (25)$$

where, QEVPR#=gain (constant)

The step amounts PR, PL and the integral amount I during PURGE OFF, i.e. the values on the right-hand side of the following equations (26), (27), are then corrected by applying a purge correction factor KEVPR (steps 333, 334 in FIG. 42):

$$PR = PR \cdot KEVPR,\ PL = PL \cdot KEVPR \quad (26)$$

$$I = I \cdot KEVPR \quad (27)$$

If the value of KEPVR is made greater than 1.0, the value of the left-hand side becomes greater than the value of the right-hand side of equations (26), (27), so the amplitude of $\alpha$ can be increased.

The following values express the relation between TP and TEFC:

(i) TP/(TP-TEFC)

(ii) (TP - TEFC)/TP (iii) TEFC/TP (iv) TP/TEFC

The following values, which express the relation between the basic injection amount and the purge fuel flowrate, and which use TEF instead of TEFC, are a little less precise:

(v) TP/(TP - TEF)

(vi) (TP - TEF)/TP (vii) TEF/TP (viii) TP/TEF

Of these values, TEFC and TEF may be 0 (when purge proceeds rapidly, and all the purge gas is air flow). In this case, the values (iv) and (viii) become infinite which is undesirable.

If TEFC and TEF are applied as in (iii), (vii) and these values are 0, PR=PL=I=O from [22], [23]. Therefore, when using the values for (iii) and (vii), the following equations for example must be used instead of equations (26), (27):

$$PR = PR \cdot (1 + KEVPR),\ PL = PL \cdot (1 + KEVPR) \quad (28)$$

$$I = I \cdot (I + KEVPR) \quad (29)$$

The actual decrease in the basic updating amounts (step amount and integral amount) of $\alpha$ during PURGE OFF is greater the greater is the proportion of TEFC or TEF relative to TP. The purge correction factor KEVPR must therefore be increased the larger is the proportion of TEFC to TP.

In this case, as the values of (ii) and (vi) become smaller the larger is the proportion of TEFC to TP, extra work is required if (ii) and (vi) are used.

This leaves (i) and (v). In this embodiment, (i) is applied as it is more precise.

Figure 42:
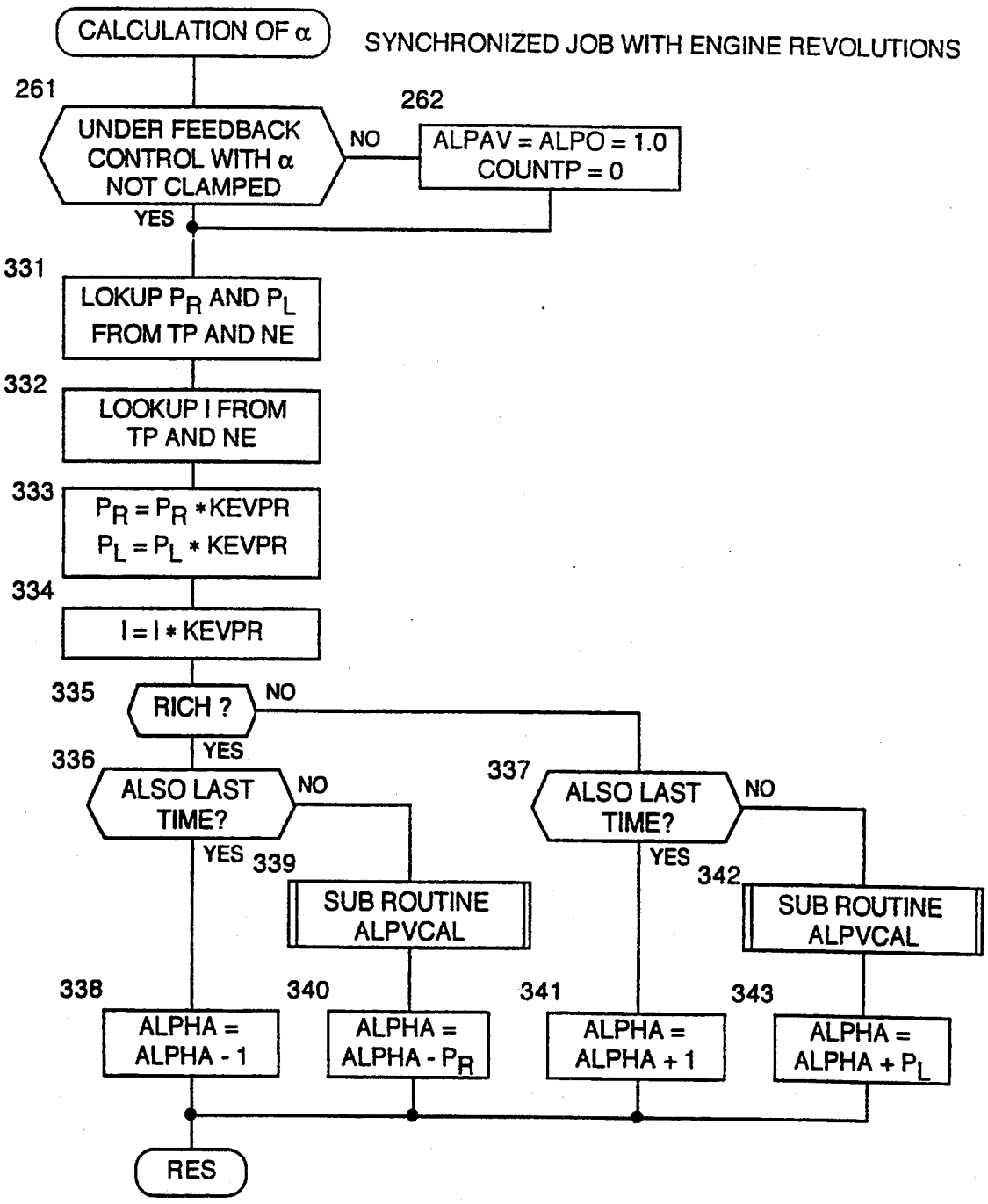
FIG. 42 is a flowchart showing the process of calculating the AFR feedback correction coefficient $\alpha$ according to the second embodiment of this invention.

The basic updating amounts of $\alpha$ during PURGE OFF, i.e. the step mounts PR and PL, mid the integral amount I on the right-hand side of equations (26), (27)), are calculated from TP and the engine rotation speed NE by looking up the maps shown in FIG. 44, FIG. 45 and FIG. 46 (steps 331, 332 in FIG. 42).

Insofar as concerns the step amounts PR, PL, the reason why different values are assigned depending on running conditions as in FIG. 44 and FIG. 45, is that the required exhaust performance and running performance are different for each set of running conditions. In FIG. 44 and FIG. 45, the values of the step amounts PR, PL are smaller the higher the load. This is because on high load, there is a large torque fluctuation and surge may easily occur, therefore by reducing the values of PR, PL on high load, surge can be prevented. Further, the exhaust gas temperature is lower and the conversion efficiency of the catalytic converter is lower at lower engine speeds, hence the values of the step amounts PR, PL are increased and the amplitude of $\alpha$ is increased so as to cause the AFR to vary at these low speeds. In this way, the conversion efficiency of the catalytic converter is prevented from deteriorating at low engine speeds. The values of PR, PL in the figure are examples found from experiment.

At the same time, based on the output of the $O_2$ sensor, it is determined whether the AFR has just inverted to rich or to lean, or whether it is continuously rich or lean. Based on these judgment results PR, PL or I is selected, the selected result is updated, and the AFR feedback correction coefficient ALPHA ($=\alpha$) is updated (steps 335–338, 340, 341, 343 in FIG. 42).

The action of in this embodiment win now be described with reference to FIG. 47. This figure refers to the situation when there is a change-over to PURGE ON.

There is a correlation between the control period of $\alpha$ and the conversion efficiency of the catalytic converter. The step amounts and integral amount during PURGE OFF are determined so that the control period of $\alpha$ is such that the conversion efficiency of the catalytic converter is optimized.

However, during PURGE ON, the purge fuel flowrate equivalent value TEFC is subtracted from TP, mid this reduced value (TP - TEFC) is corrected by $\alpha$. When the proportion of TEFC relative to TP is large, therefore, the step amounts and integral amount effectively become smaller during PURGE ON although the values given for these amounts before and after purge are the same. If these actual step amounts and integral amount are used, therefore, the control period of $\alpha$ is lengthened from A to B and moves away from the required value as shown by the solid line in FIG. 57.

Further, as the control center of $\alpha$ is shifted to lean, NOx increases.

Therefore, according to this embodiment, the step amounts PR, PL and the integral amount I are made larger during PURGE ON than during PURGE OFF by a purge correction factor KEVPR which is larger than 1.0.

During PURGE OFF, fuel is supplied to the cylinder only by the injector 8, and its total amount is corrected by $\alpha$. However during PURGE ON, although the purge fuel flowrate is added to the fuel amount from the injector 8, the purge fuel flowrate part of the total fuel amount cannot be corrected by $\alpha$. This part of the fuel which cannot be corrected by $\alpha$, increases the larger the ratio of TP to (TP - TEFC). The step amounts PR, PL and the integral amount I are therefore increased by the purge correction factor KEPVR which is proportional to in this ratio, so that the actual decrease of the step amounts and integral amount during PURGE ON is compensated. In practice, the value of the gain QEPVR# is chosen by experiment so that the AFR variation during PURGE ON is the same as that during PURGE OFF under feedback control.

Figure 47:
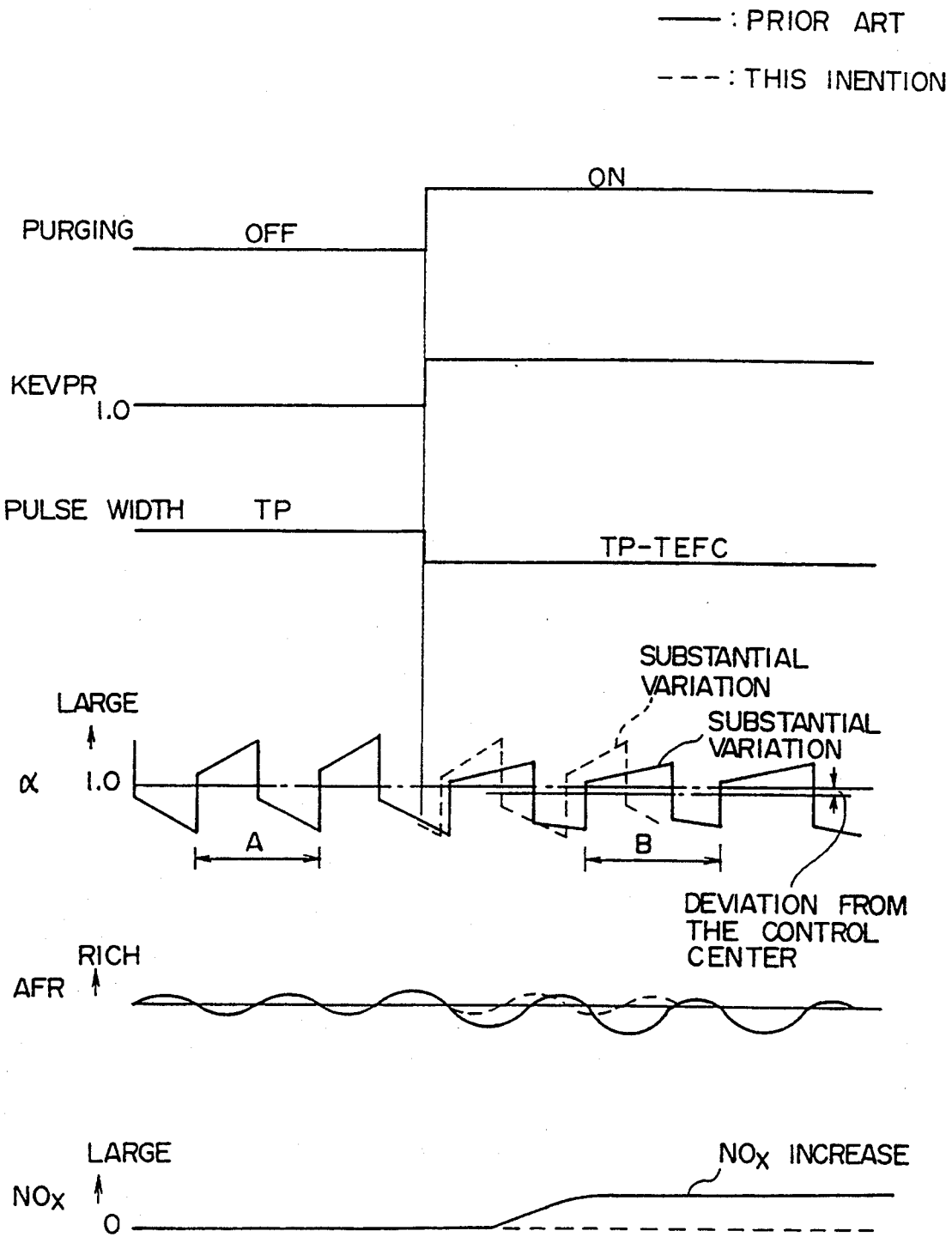
FIG. 47 is a waveform diagram showing the variation of AFR according to this invention with reference to a conventional controller.

By making this addition correction using the purge correction factor KEVPR, as shown by the broken line in FIG. 47, the step amounts and integral amount effectively become the same during PURGE ON and PURGE OFF. The control period of $\alpha$ therefore does not become longer than the required value even during purge.

Further, as the step amounts and integral amount do not change before and after purge, the control center of $\alpha$ does not shift toward lean, and therefore the increase of NOx is suppressed.

On the other hand when there is a change-over to PURGE ON while $\alpha$ is increasing, the control center of $\alpha$ would shift to rich, and CO, HC would increase unlike the case of FIG. 47. However, by effectively making the step amounts and integral amount the same before and after purge, this increase of CO, HC is also suppressed.

According to this embodiment, the basic updating amount of $\alpha$ was increased according to the relation between the basic injection amount and purge fuel flowrate, however during PURGE ON, the basic updating amount of $\alpha$ may merely be increased only by a constant factor. In this case, the effect of the embodiment is still the same provided that the step amounts and integral amount are the same before and after purge.

However, there is a possibility that the actual step amounts and integral amount before and after purge may be different due to change of purge fuel concentration or purge rate, and in this case the correction precision will decrease. In some cases, the step amounts and integral amount may actually decrease leading to the same problems as in the prior art, conversely there may be too much correction.

Therefore, as described hereinabove in this embodiment, it is preferable to make the purge correction factor KEPVR vary according to the relation between the basic fuel injection amount and the purge fuel flowrate. Then, even if the purge fuel concentration or purge rate are different, the correction precision does not fall.

According to this embodiment, both the step amounts and the integral amount are increased by the correction factor KEVPR, but this correction may also be applied to either the step amounts or the integral amount alone.

Further, the valve 21 may be a rotary valve or a valve driven by a step motor, and in addition to predicting the purge fuel concentration by the purge learning value WC, the purge fuel concentration may also be detected by a sensor.

The foregoing description of the preferred embodiments for the purpose of illustrating in this invention is not to be considered as limiting or restricting the invention, since many modifications may be made by those skilled in the art without departing from the scope of the invention.

The embodiments of in this invention in which an exclusive property or privilege is claimed are defined as follows:

1. A fuel injection controller for an engine having a combustion chamber, an intake passage connected to said combustion chamber, an injector for injecting fuel from said fuel tank into said intake passage, means for detecting running conditions of the engine, a purge passage for introducing fuel vapor from said fuel taken into said intake passage as a purge gas, and a purge valve which opens and closes said purge passage according to said running conditions, said controller comprising:

means for setting a basic fuel injection amount of said injector based on a predetermined target air-fuel ratio of air and fuel supplied to said combustion chamber, means for detecting a real air-fuel ratio of air and fuel supplied to said combustion chamber, feedback means having a feedback gain for feedback correcting said basic fuel injection amount by a predetermined correction unit amount such that said detected air-fuel ratio is identical to said target air-fuel ratio, and means for increasing said feedback gain by a predetermined amount when said purge valve is open.

2. A fuel injection controller as defined in claim 1, wherein said feedback correcting means causes said basic injection amount to vary in stepwise fashion when said air-fuel ratio detected by said detecting means has varied beyond said target air-fuel ratio and causes said basic fuel injection amount to vary progressively at other times, and said increasing means adds predetermined increases to said step variation amount and progressive variation amount respectively.

3. A fuel injection controller for an engine having a combustion chamber, an intake passage connected to said combustion chamber, a fuel tank for storing fuel, an injector for injecting fuel from said fuel tank into said intake passage, means for detecting running conditions of the engine, a purge passage for introducing fuel vapor from said fuel tank into said intake passage as a purge gas, and a purge valve which opens and closes said purge passage according to said running conditions, said controller comprising:

means for setting a basic fuel injection amount of said injector based on a predetermined target air-fuel ratio and said running conditions, means for detecting a real air-fuel ratio of air and fuel supplied to said combustion chamber, feedback means having a feedback gain for feedback correcting said basic fuel injection amount by a predetermined correction unit amount such that said detected air-fuel ratio is identical to said target air-fuel ratio, means for detecting a purge fuel flowrate in said purge passage, and means for modifying said feedback gain so that it varies according to said purge fuel flowrate when said purge valve is open.

4. A fuel injection controller as defined in claim 3, wherein said modifying means increases said feedback gain in proportion to an increase of said purge fuel flowrate.

5. A fuel injection controller as defined in claim 3, wherein said feedback correcting means causes said basic fuel injection amount to vary in stepwise fashion when the air-fuel ratio detected by said detecting means has varied beyond said target air-fuel ratio and causes said basic fuel injection amount to vary progressively at other times, and said increasing means increases said step variation amount and progressive variation amount respectively according to said purge fuel flowrate.

6. A fuel injection controller as defined in claim 3, wherein said flowrate detecting means computes said purge fuel flowrate based on a pressure difference before and after said purge valve, and based on a variation of said air-fuel ratio due to said purge valve opening or closing.

7. A fuel injection controller for an engine having a combustion chamber, an intake passage connected to said combustion chamber, a fuel tank for storing fuel, an injector for injecting fuel from said fuel tank into said intake passage, means for detecting running conditions of the engine, a purge passage for introducing fuel vapor from said fuel tank into said intake passage as a purge gas, and a purge valve which opens and closes said purge passage according to said running conditions, said controller comprising:

means for setting basic fuel injection amount of said injector based on a predetermined target air-fuel ratio and said running conditions, means for detecting a real air-fuel ratio of air and fuel supplied to said combustion chamber, feedback means having a feedback gain for feedback correcting said basic fuel injection amount by a predetermined correction unit amount such that said detected air-fuel ratio is identical to said target air-fuel ratio, means for detecting a purge fuel flowrate in said purge passage, means for decreasing said basic fuel injection amount when said purge valve is open by an amount equivalent to said detected purge fuel flowrate, and means for increasing said feedback gain by a predetermined amount when said purge valve is open.

8. A fuel injection controller as defined in claim 7, wherein said feedback correcting means causes said basic fuel injection amount to vary in stepwise fashion when the air-fuel ratio detected by said air-fuel ratio detecting means has varied beyond said target air-fuel ratio and causes said basic fuel injection amount to vary progressively at other times, and said increasing means adds predetermined increases to said step variation mount and progressive variation amount respectively.

9. A fuel injection controller as defined in claim 7, wherein said flowrate detecting means computes said purge fuel flowrate based on a pressure difference before and after said purge valve, and based on a variation of said air-fuel ratio due to said purge valve opening or closing.

10. A fuel injection controller for an engine having a combustion chamber, an intake passage connected to said combustion chamber, a fuel tank for storing fuel, an injector for injecting fuel from said fuel tank into said intake passage, means for detecting running conditions of the engine, a purge passage for introducing fuel vapor from said fuel tank into said intake passage as a purge gas, and a purge valve which opens and closes said purge passage according to said running conditions, said controller comprising:

means for setting a basic fuel injection amount of said injector based on a predetermined target air-fuel ratio and said running conditions, means for detecting a real air-fuel ratio of air and fuel supplied to said combustion chamber, feedback means having feedback gain for feedback correcting said basic fuel injection amount by a predetermined correction unit amount such that said detected air-fuel ratio is identical to said target air-fuel ration, means for detecting a purge fuel flowrate in said purge passage, means for decreasing said basic fuel injection amount when said purge valve is open by an amount equivalent to said detected purge fuel flowrate, and means for modifying said predetermined feedback gain so that it varies according to said purge fuel flowrate when said purge valve is open.

11. A fuel injection controller as defined in claim 10, wherein said modifying means increases said feedback gain in proportion to an increase of said purge fuel flowrate.

12. A fuel injection controller as defined in claim 10, wherein feedback correcting means causes said basic fuel injection amount to vary in stepwise fashion when said air-fuel ratio detected by said detecting means has varied beyond said target air-fuel ratio and causes said basic fuel injection mount to vary progressively at other times, and said increasing means increases said step variation amount and progressive variation amount respectively according to said purge fuel flowrate.

13. A fuel injection controller as defined in claim 10, wherein said flowrate detecting means computes said purge fuel flowrate based on a pressure difference before and after said purge valve, and based on a variation of said air-fuel ratio due to said purging opening or closing.

14. A fuel injection controller as defined in claim 1, wherein said means for increasing comprises means for modifying feedback gain when purging takes place by changing coefficients of PI control thereof.

15. A fuel injection controller as defined in claim 3, wherein said means for modifying comprises means for varying parameters of PI control when a purging operation takes place.

16. A fuel injection controller as defined in claim 7, wherein said means for increasing comprises means for modifying feedback gain when purging takes place by changing coefficients of PI control thereof.

17. A fuel injection controller as defined in claim 10, wherein said means for modifying comprises means for varying parameters of PI control when a purging operation takes place.

* * * * *